US011805952B2

(12) United States Patent
Ahn et al.

(10) Patent No.: US 11,805,952 B2
(45) Date of Patent: Nov. 7, 2023

(54) CLEANER

(71) Applicant: LG ELECTRONICS INC., Seoul (KR)

(72) Inventors: Gee Young Ahn, Seoul (KR); Youngho Kim, Seoul (KR); Jonghoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 390 days.

(21) Appl. No.: 16/925,763

(22) Filed: Jul. 10, 2020

(65) Prior Publication Data

US 2021/0076893 A1 Mar. 18, 2021

(30) Foreign Application Priority Data

Sep. 17, 2019 (KR) ..... 10-2019-0114157

(51) Int. Cl.
*A47L 11/282* (2006.01)
*A47L 11/40* (2006.01)

(52) U.S. Cl.
CPC ..... *A47L 11/282* (2013.01); *A47L 11/4005* (2013.01); *A47L 11/4061* (2013.01); *A47L 11/4069* (2013.01); *A47L 11/4072* (2013.01); *A47L 11/4083* (2013.01); *A47L 11/4088* (2013.01)

(58) Field of Classification Search
CPC ..... A47L 11/282; A47L 11/4005; A47L 11/4061; A47L 11/4069; A47L 11/4072; A47L 11/4083; A47L 11/4088; A47L 2201/04; A47L 11/4066; A47L 11/4011; A47L 11/4038; A47L 11/4063;
(Continued)

(56) References Cited

U.S. PATENT DOCUMENTS

2005/0166356 A1 8/2005 Uehigashi
2011/0191976 A1 8/2011 Yan
(Continued)

FOREIGN PATENT DOCUMENTS

AU 2018102050 1/2019
CN 103584794 2/2014
(Continued)

OTHER PUBLICATIONS

International Search Report dated Sep. 11, 2020 issued in International Application No. PCT/KR2020/007162.
(Continued)

*Primary Examiner* — David Redding
(74) *Attorney, Agent, or Firm* — KED & ASSOCIATES, LLP

(57) ABSTRACT

A cleaner is provided. The cleaner includes a body, a first rotating plate, a second rotating plate, a first mop, a second mop, a support wheel, and an auxiliary wheel. The lowest parts of the first rotating plate and the second rotating plate are higher than a virtual reference line connecting the lowest part of the support wheel to the lowest part of the auxiliary wheel, and the lowest parts of the first mop and the second mop are lower than the reference line. The cleaner can prevent the first rotating plate, the second rotating plate, and the floor from being damaged while mopping of the floor is performed by the first mop and the second mop.

20 Claims, 12 Drawing Sheets

(58) Field of Classification Search
CPC .... B25J 9/1666; B25J 11/0085; B25J 9/1676; B25J 19/0091
See application file for complete search history.

(56) References Cited

U.S. PATENT DOCUMENTS

| | | | | |
|---|---|---|---|---|
| 2011/0278082 | A1 | 11/2011 | Chung | |
| 2014/0201941 | A1* | 7/2014 | Oka | A47L 5/22 15/340.1 |
| 2015/0128364 | A1 | 5/2015 | Dooley | |
| 2015/0142169 | A1 | 5/2015 | Kim et al. | |
| 2016/0331200 | A1 | 11/2016 | Yang et al. | |
| 2018/0249872 | A1 | 9/2018 | Park | |
| 2018/0263447 | A1 | 9/2018 | Yim et al. | |
| 2019/0038106 | A1 | 2/2019 | Jang et al. | |
| 2019/0191952 | A1 | 6/2019 | Johnson et al. | |
| 2019/0216285 | A1 | 7/2019 | Jang et al. | |
| 2019/0290088 | A1 | 9/2019 | Goto et al. | |
| 2020/0138257 | A1 | 5/2020 | Koura | |

FOREIGN PATENT DOCUMENTS

| | | |
|---|---|---|
| CN | 103584797 | 2/2014 |
| CN | 108403007 | 8/2018 |
| CN | 109480712 | 3/2019 |
| CN | 208573607 | 3/2019 |
| CN | 208598298 | 3/2019 |
| CN | 109589050 | 4/2019 |
| CN | 109688884 | 4/2019 |
| CN | 209122081 | 7/2019 |
| EP | 3440981 | 2/2019 |
| JP | 2002-143063 | 5/2002 |
| JP | 2005-211368 | 8/2005 |
| JP | 2006-087507 | 4/2006 |
| JP | 2018-099293 | 6/2018 |
| KR | 10-2015-0057959 | 5/2015 |
| KR | 10-1613446 | 4/2016 |
| KR | 10-2018-0105109 | 9/2018 |
| KR | 10-2018-0106225 | 10/2018 |
| KR | 10-2019-0003776 | 1/2019 |
| KR | 10-2019-0015934 | 2/2019 |
| KR | 10-2000068 | 7/2019 |
| TW | 2019 09824 | 3/2019 |
| WO | WO 2015/186944 | 12/2015 |
| WO | WO 2015186944 | 12/2015 |
| WO | WO 2017/217570 | 12/2017 |
| WO | WO 2018/116721 | 6/2018 |
| WO | WO 2019/031795 | 2/2019 |

OTHER PUBLICATIONS

International Search Report dated Sep. 4, 2020 issued in International Application No. PCT/KR2020/007164.
U.S. Appl. No. 16/994,206, filed Aug. 14, 2020.
U.S. Office Action dated Oct. 12, 2022 issued in U.S. Appl. No. 16/994,206.
Chinese Office Action dated Sep. 20, 2022 issued in CN Application No. 202080067411.6.
Chinese Office Action dated Sep. 29, 2022 issued in CN Application No. 202080064702.X.
U.S. Office Action dated Mar. 22, 2023 issued in U.S. Appl. No. 16/994,206.
Australian Office Action dated Apr. 15, 2023 issued in Application No. 2020354043.
Australian Office Action dated Jun. 10, 2023 issued in Application No. 2020348105.
Extended European Search Report dated Aug. 17, 2023 issued in Application No. 20866017.6.
U.S. Office Action dated Aug. 15, 2023 issued in U.S. Appl. No. 16/994,206.
Translation of CN 109589050 (Espacenet) (Year: 2019).

* cited by examiner

CLEANER

CROSS-REFERENCE TO RELATED APPLICATIONS

This application claims priority under 35 U.S.C. § 119 to Korean Application No. 10-2019-0114157 filed on Sep. 17, 2019, whose entire disclosure is hereby incorporated by reference. This application is related to U.S. application Ser. No. 16/994,206 filed, whose entire disclosure is also hereby incorporated by reference.

BACKGROUND

1. Field

The present disclosure relates to a cleaner, and more specifically, to a cleaner capable of cleaning a floor using mops that rotate while in contact with the floor.

2. Background

A robot cleaner may include a motor, various sensors, and artificial intelligence (AI) technology to clean an area while traveling autonomously. The robot cleaner may be configured, for example, to suction dust using a vacuum, to sweep up dust, or to wipe a surface using a mop.

Korean Patent No. 10-1613446 discloses a first type of robot cleaner that includes a main body, a driver, a first rotating member and a second rotating member. In addition, the robot cleaner may include a first cleaner (or pad) and a second cleaner (or pad) made of cloth, a mop, a nonwoven fabric, a brush, or the like. The first cleaner may be coupled to a first fixing member of the first rotating member, and the second cleaner may be coupled to a second fixing member of the second rotating member. As the first cleaner and the second cleaner are rotated by the rotational motion of the first rotating member and the second rotating member, foreign matter stuck to the floor may be removed through friction between the first cleaner and the second cleaner and the floor surface, and the frictional force can be used for moving the robot cleaner. For example, the first type of robot cleaner can move while cleaning the floor based on the first cleaner and the second cleaner being rotated.

However, at least one of the first cleaner or the second cleaner may be separated, respectively, from the first fixing member or the second fixing member, and the first type of robot cleaner may be inadvertently operated while at least one of the first cleaner or the second cleaner is separated from the robot cleaner. For example, a user may accidentally operate the first type of robot cleaner without attaching that the first cleaner or the second cleaner, or the first cleaner or the second cleaner may unintendedly become separated from the robot cleaner by friction with the floor or due to jamming. If the first fixing member or the second fixing member are rotated while directly rubbing against the floor, the first fixing member or the second fixing member may be damaged or may scratch the floor.

Furthermore, the first type of robot cleaner may include a liquid management unit for discharging liquid to the first cleaner and the second cleaner. However, as the liquid stored in the liquid management unit decreases as a result of use, the first type of robot cleaner may become imbalanced as the center of gravity in the entire robot cleaner changes. As a result, the robot cleaner may not move or clean as intended. In particular, since the first type of robot cleaner moves or travels based on frictional forces with the floor that are generated when the first cleaner and the second cleaner are rotated, changes in the center of gravity in the first type of robot cleaner may cause changes in the frictional force and contact points between the floor and the first cleaner or the second cleaner such that the first type of robot cleaner may not move an intended direction or with an intended speed or force. To address this problem, the liquid management unit may be disposed at a central position such that a center of gravity of the liquid management unit corresponds to the center of gravity of the first type of robot cleaner, and the center of gravity of the robot cleaner does not change as liquid is used, but this design may cause many design constraints, such as to limit locations for the liquid management unit and to prevent other components from being positioned at this central region.

Korean Patent Registration No. 10-2000068 discloses a second type of cleaner that includes a mop module including a mop portion and a collection module. The second type of cleaner includes a mop portion and a rotating plate. The mop portion is detachable from a mop fixing portion of the rotating plate. The second type of cleaner may be inadvertently operated while the mop portion is separated from the cleaner. In this case, the rotating plate or the floor may be damaged, as described with respect to the first type of cleaner. Furthermore, stable cleaning and operation of the second type of cleaner can be further improved even through a separate collection module is not provided.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims. X, Y, and Z directions shown in the accompanying drawings are orthogonal to each other.

Figure 1:
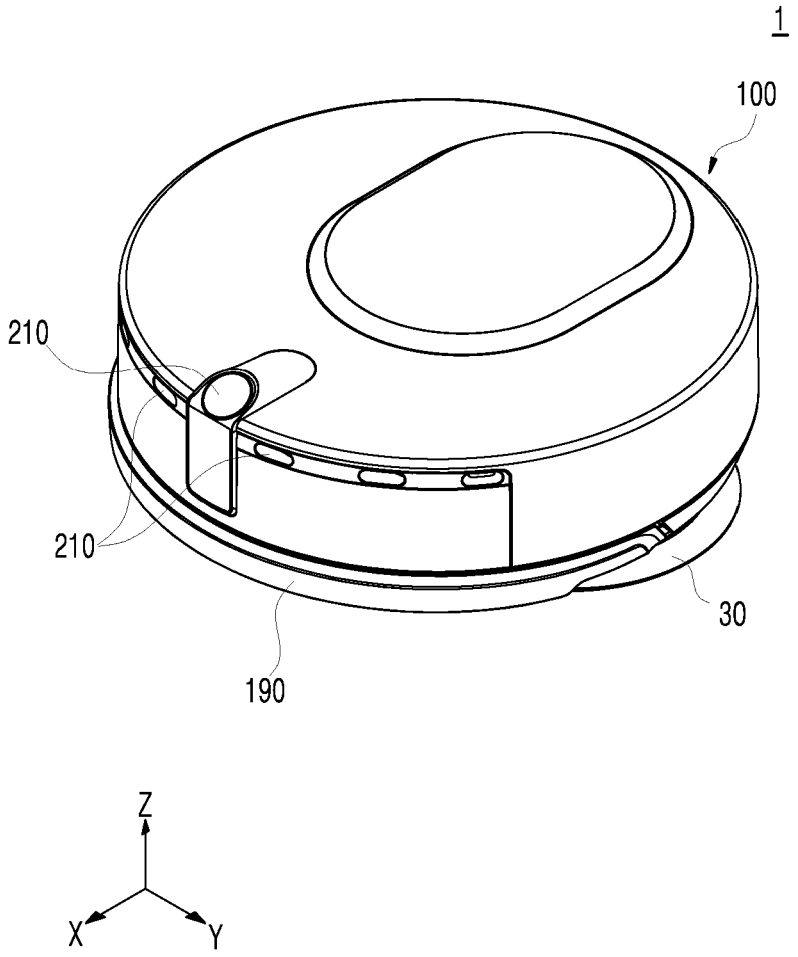
FIG. 1 is a diagram illustrating a perspective view of a cleaner according to an embodiment of the present disclosure.
Figure 2:
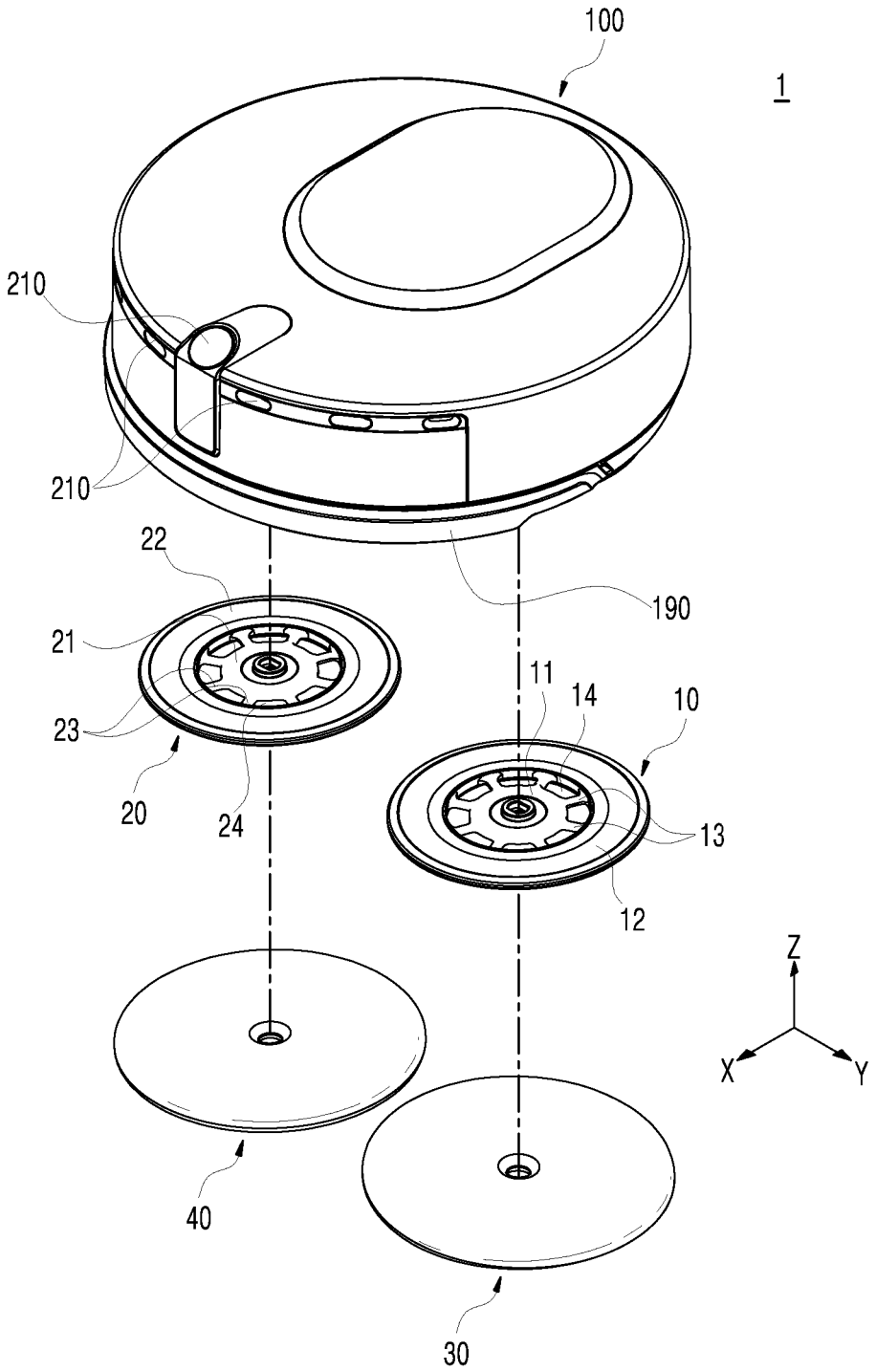
FIG. 2 is a diagram illustrating the partial configuration separated from the cleaner shown in FIG. 1.
Figure 3:
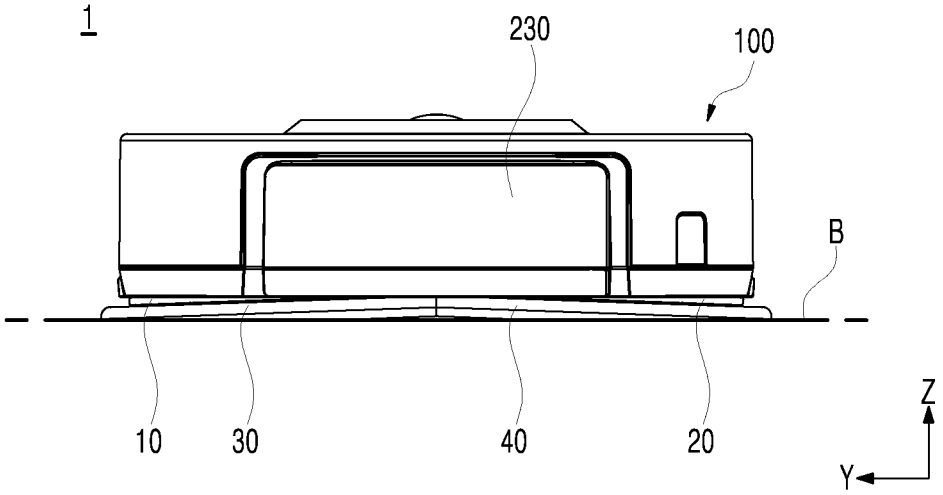
FIG. 3 is a diagram illustrating a back view of the cleaner shown in FIG. 1.
Figure 4:
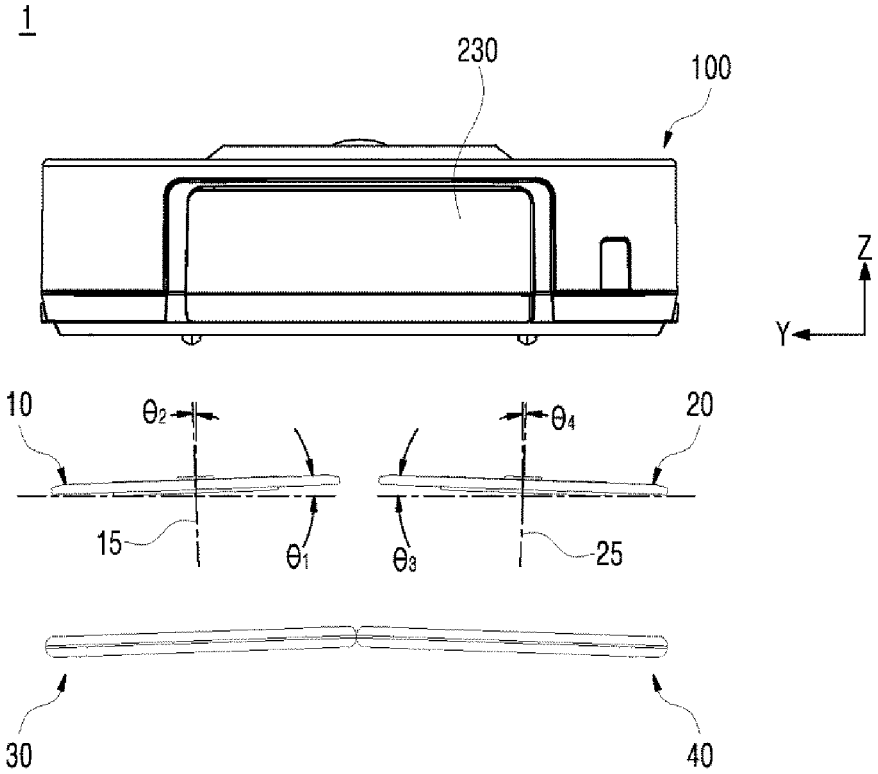
FIG. 4 is a diagram illustrating the partial configuration separated from the cleaner shown in FIG. 3.

FIG. 1 is a diagram illustrating a perspective view of a cleaner 1 according to an embodiment of the present disclosure. FIG. 2 is a diagram illustrating the partial configuration separated from the cleaner 1 shown in FIG. 1. FIG. 3 is a diagram illustrating a back view of the cleaner 1 shown in FIG. 1. FIG. 4 is a diagram illustrating the partial configuration separated from the cleaner 1 shown in FIG. 3. The cleaner 1 according to embodiments of the present disclosure may be a robot cleaner 1. The cleaner 1 according to an embodiment of the present disclosure may be placed on a floor surface B and may move along and clean the floor surface B. Accordingly, hereinafter, in order to describe the cleaner 1, a vertical direction may be set based on a state in which the cleaner 1 is placed on the floor.

Further, in the following description, it is assumed that a side of the cleaner 1 where support wheels 110, 120, and 130 (to be described below) are coupled relative to a first rotating plate 10 and a second rotating plate 20 correspond to a "front" side of the cleaner 1. The 'lowest part' of a component described in embodiments of the present disclosure may be a part at which each component is located lowest or closest to the floor when the cleaner 1 is placed on the floor.

The cleaner 1 according to an embodiment of the present disclosure may include a body 100, a first rotating plate 10, a second rotating plate 20, a first mop 30, and a second mop 40. The body 100 may form an overall appearance of the cleaner 1 or may be formed as a frame to which various components are coupled. Component constituting the cleaner 1 may be coupled to the body 100 or may be accommodated in the body 100. The body 100 may be divided into a lower body 100*a* and an upper body 100*b*, and the components of the cleaner 1 may be provided in a space where the lower body 100*a* and the upper body 100*b* are coupled to each other (see FIG. 10).

In an embodiment of the present disclosure, the body 100 may have a width (or diameter) larger in the horizontal direction (direction parallel to X and Y) than the height in the vertical direction (direction parallel to Z). Such a body 100 may provide an advantageous structure for helping the cleaner 1 to have a stable structure and to avoid obstacles when moving (traveling). When viewed from above or below, the body 100 may be formed in various forms, such as a circle, an oval, or a rectangle.

The first rotating plate 10 may be formed to have a predetermined area and may be formed substantially in the form of a flat plate or a flat frame. The first rotating plate 10 may generally be positioned to extend substantially horizontally. As such, the first rotating plate 10 has a width (or diameter) in the horizontal direction set to be significantly larger than the height in the vertical direction. The first rotating plate 10 coupled to the body 100 may be parallel to the floor surface B, or may be inclined with respect to the floor surface B.

The first rotating plate 10 may be formed in a circular plate shape, and the bottom surface of the first rotating plate 10 may generally have a circular shape. The first rotating plate 10 may be formed in a rotationally symmetrical form as a whole. The first rotating plate 10 may include a first central plate 11, a first outer plate 12, and first spokes 13.

The first central plate 11 may be rotatably coupled to the body 100 while forming the center of the first rotating plate 10. The first central plate 11 may be coupled to the lower portion of the body 100, and the upper surface of the first central plate 11 may be coupled to the body 100 while facing the bottom surface of the body 100.

A rotation axis 15 of the first rotating plate 10 may be formed along a direction passing through the center of the first central plate 11. In addition, the rotation axis 15 of the first rotating plate 10 may be formed along a direction orthogonal to the floor surface B, or may have a predetermined inclination with respect to the direction perpendicular to the floor surface B.

The first outer plate 12 may be formed to surround the first central plate 11 while being spaced apart from the first central plate 11. The first spokes 13 may connect the first central plate 11 and the first outer plate 12, and may be repeatedly formed along the circumferential direction of the first central plate 11. For example, the first spokes 13 may be arranged at equal intervals. A plurality of holes 14 penetrating vertically between the first spokes 13 may be provided, and a liquid (such as water, a wax or other polishing compound, or a cleaning fluid) discharged from a water supply tube 240, to be described below, may be transferred to the first mop 30 through the holes 14.

In the cleaner 1 according to an embodiment of the present disclosure, the bottom surface of the first rotating plate 10 coupled to the body 100 may form a predetermined incline with respect to the floor surface B. Herein, the rotation axis 15 of the first rotating plate 10 may have a predetermined incline with respect to a direction perpendicular to the floor surface B. In the cleaner 1 according to an embodiment of the present disclosure, an angle 81 formed between the bottom surface of the first rotating plate 10 and the floor surface B may be correspond to an angle 82 formed between the rotation axis 15 of the first rotating plate 10 and the direction perpendicular to the floor surface B. Accordingly, when the first rotating plate 10 rotates with respect to the body 100, the bottom surface of the first rotating plate 10 may be configured to maintain the same angle with the floor surface B.

The second rotating plate 20 may be formed to have a predetermined area and may be formed in the form of a flat plate or a flat frame. The second rotating plate 20 generally lies generally horizontally. As such, a width (or diameter) in the horizontal direction may be set to be significantly larger than the height in the vertical direction. The second rotating plate 20 coupled to the body 100 may be disposed parallel to the floor surface B or may be inclined with respect to the floor surface B.

The second rotating plate 20 may be formed in a substantially circular plate shape, and the bottom surface of the second rotating plate 20 may generally have a circular shape. The second rotating plate 20 may be formed in a rotationally symmetrical form as a whole.

The second rotating plate 20 may include a second central plate 21, a second outer plate 22, and second spokes 23. The second central plate 21 may be rotatably coupled to the body 100 while forming the center of the second rotating plate 20. The second central plate 21 may be coupled to the lower portion of the body 100, and the upper surface of the second central plate 21 may face the bottom surface of the body 100 when coupled to the lower portion of the body 100.

A rotation axis 25 of the second rotating plate 20 may be formed along a direction passing through the center of the second central plate 21. In addition, the rotation axis 25 of the second rotating plate 20 may be formed along a direction orthogonal to the floor surface B or may have a predetermined inclination with respect to the direction orthogonal to the floor surface B.

The second outer plate 22 is formed to surround the second central plate 21 while being spaced apart from the second central plate 21. The second spokes 23 connect the second central plate 21 and the second outer plate 22 and may be repeatedly formed along the circumferential direction of the second central plate 21. The second spokes 23 may be arranged at substantially equal intervals. A plurality of holes 24 penetrating vertically between the second spokes 23 may be provided, and the liquid (such as water, a wax or polishing fluid, or a cleaning fluid) discharged from the water supply tube 240 to be described below may be transferred to the second mop 40 through the holes 24.

In the cleaner 1 according to an embodiment of the present disclosure, the bottom surface of the second rotating plate 20 coupled to the body 100 may form a predetermined incline with respect to the floor surface B. Herein, the rotation axis 25 of the second rotating plate 20 may have a predetermined incline with respect to a direction perpendicular to the floor surface B. In the cleaner 1 according to an embodiment of the present disclosure, an angle θ3, which is formed between the bottom surface of the second rotating plate 20 and the floor surface B, may substantially correspond to angle θ4, which is formed between the rotation axis 25 of the second rotating plate 20 and the direction perpendicular to the floor surface B. Accordingly, when the second rotating plate 20 rotates with respect to the body 100, the bottom surface of the second rotating plate 20 may be configured to maintain a same angle with the floor surface B.

In the cleaner 1 according to an embodiment of the present disclosure, the second rotating plate 20 may be formed to correspond to the first rotating plate 10, or may be formed to be symmetrical to the first rotating plate 10. The first rotating plate 10 may be located on the left side of the cleaner 1, whereas the second rotating plate 20 may be located on the right side of the cleaner 1. Here, the first rotating plate 10 and the second rotating plate 20 may be bilaterally symmetrical to each other with respect to a midline of the body extending in a front-to-rear direction.

The first mop 30 may be formed so that a bottom surface thereof that faces the floor B has a predetermined area, and the first mop 30 has a flat shape. The first mop 30 may have a shape in which the width (or diameter) thereof in the horizontal direction is significantly larger than the height thereof in the vertical direction. When the first mop 30 is coupled to the body 100 side, the bottom surface of the first mop 30 may be parallel to the floor surface B or may be inclined with respect to the floor surface B.

The bottom surface of the first mop 30 may be generally circular. The second mop 30 may be formed in a rotationally symmetrical form as a whole. The second mop 30 may be made of various materials that can clean the floor while being in contact with the floor. To this end, the bottom surface of the first mop 30 may be made of a cloth made of a woven or knitted fabric, a nonwoven fabric, and/or a brush having a predetermined area.

In the cleaner 1 according to an embodiment of the present disclosure, the first mop 30 may be detachably attached to the bottom surface of the first rotating plate 10 and may be coupled to the first rotating plate 10 to be rotated together with the first rotating plate 10. The first mop 30 may be in close contact with the bottom surface of the first outer plate 12 and may be in close contact with the bottom surface of the first central plate 11 and the first outer plate 12.

The first mop 30 may be detachably attached to the second rotating plate 10 using various devices and methods. In one embodiment, at least a portion of the first mop 30 may be coupled to the first rotating plate 10 by being hooked to or inserted into the first rotating plate 10. In another embodiment, a separate device, such as a clamp that couples the first mop 30 to the first rotating plate 10, may be provided. In still another embodiment, one side of one pair of fastening devices that can be coupled to and separated from each other may be fixed to the first mop 30, and the other side thereof may be fixed to the first rotating plate 10. As a specific example of the fastening device, a pair of magnets that work with each other, a pair of strips of Velcro that are coupled to each other, or a pair of buttons (a female button and a male button) that are coupled to each other may be used. When the first mop 30 is coupled to the first rotating plate 10, the first mop 30 and the first rotating plate 10 may be coupled to overlap each other, and the first mop 30 may be coupled to the first rotating plate 10 such that the center of the first mop 30 coincides with the center (e.g., rotational axis 15) of the first rotating plate 10.

The second mop 40 may be formed so that a bottom surface thereof that faces the floor has a predetermined area, and the second mop 40 has a flat shape. The second mop 40 has a shape in which the width (or diameter) in the horizontal direction is significantly larger than the height in the vertical direction. When the second mop 40 is coupled to the body 100, the bottom surface of the second mop 40 may be parallel to the floor surface B, or may be inclined with respect to the floor surface B.

The bottom surface of the second mop 40 may be generally circular. The second mop 40 may be formed in a rotationally symmetrical form as a whole. The second mop 40 may be made of various materials that can clean the floor while being in contact with the floor. To this end, the bottom surface of the second mop 40 may be made of a cloth made of a woven or knitted fabric, a nonwoven fabric, and/or a brush having a predetermined area.

In the cleaner 1 according to an embodiment of the present disclosure, the second mop 40 may be detachably attached to the bottom surface of the second rotating plate 20 and may be coupled to the second rotating plate 20 to be rotated together with the second rotating plate 20. The second mop 40 may be in close contact with the bottom surface of the second outer plate 22 and may be in close contact with the bottom surface of the second central plate 21 and the second outer plate 22.

The second mop 40 may be detachably attached to the second rotating plate 20 using various devices and methods. In one embodiment, at least a portion of the second mop 40 may be coupled to the second rotating plate 40 by being hooked to or inserted into the second rotating plate 20. In another embodiment, a separate device, such as a clamp, which couples the second mop 30 to the second rotating plate 10, may be provided. In still another embodiment one side of one pair of fastening devices coupled to and separated from each other may be fixed to the second mop 40 and the other side thereof may be fixed to the second rotating plate 20. As a specific example of the fastening device, a pair of magnets that work with each other, a pair of strips of Velcro that are coupled to each other, or a pair of buttons (a female button and a male button) that are coupled to each other may be used. When the second mop 40 is coupled to the second rotating plate 20, the second mop 40 and the second rotating plate 20 may be coupled to overlap each other, and the second mop 40 may be coupled to the second rotating plate 20 such that the center of the second mop 40 coincides with the center (e.g., rotational axis 25) of the second rotating plate 20.

In the cleaner 1 according to an embodiment of the present disclosure, the first rotating plate 10 and the second rotating plate 20 may respectively be inclined with respect to the floor surface B such that the sides of the first rotating plate 10 and the second rotating plate 20 that are closer to each other are spaced further apart from the floor surface B than the sides of the first rotating plate 10 and the second rotating plate 20 that are farther from each other. That is, the first rotating plate 10 and the second rotating plate 20 may be formed such that the sides thereof that are farther from the center of the cleaner 1 are located closer to the floor than the sides thereof that are closer to the center of the cleaner 1 (see FIGS. 3 and 4). Here, the rotation axis 15 of the first rotating plate 10 may be formed to be perpendicular to the bottom surface of the first rotating plate 10, and the rotation axis 25 of the second rotating plate 20 may be formed to be perpendicular to the bottom surface of the second rotating plate 20.

When the first mop 30 is coupled to the first rotating plate 10 and the second mop 40 is coupled to the second rotating plate 20, the sides of the first mop 30 and the second mop 40 that are farther from each other may be in relatively stronger contact with the floor. When the first rotating plate 10 rotates, frictional force may be generated between the bottom surface of the first mop 30 and the floor surface B. Here, since the generation point and direction of the frictional force deviate from the rotation axis 15 of the first rotating plate 10, the first rotating plate 10 moves against the floor surface B, and the cleaner 1 can thus move along the floor surface B.

Further, when the second rotating plate 20 rotates, frictional force is generated between the bottom surface of the second mop 40 and the floor surface B. Here, since the generation point and direction of the frictional force deviate from the rotation axis 25 of the second rotating plate 20, the second rotating plate 20 moves against the floor surface B, and the cleaner 1 can thus move along the floor surface B.

When the first rotating plate 10 and the second rotating plate 20 rotate at the same speed in opposite directions, the cleaner 1 may move straight, forward or backward. For example, when viewed from above, the cleaner 1 may move forward when the first rotating plate 10 rotates counterclockwise and the second rotating plate 20 rotates clockwise.

When only one of the first rotating plate 10 and the second rotating plate 20 rotates, the cleaner 1 may change direction. When the rotation speed of the first rotating plate 10 is different from the rotation speed of the second rotating plate or when the first rotating plate 10 and the second rotating plate 20 rotate in the same direction, the cleaner 1 can move while changing direction, and can move in a curved direction.

Figure 5A:
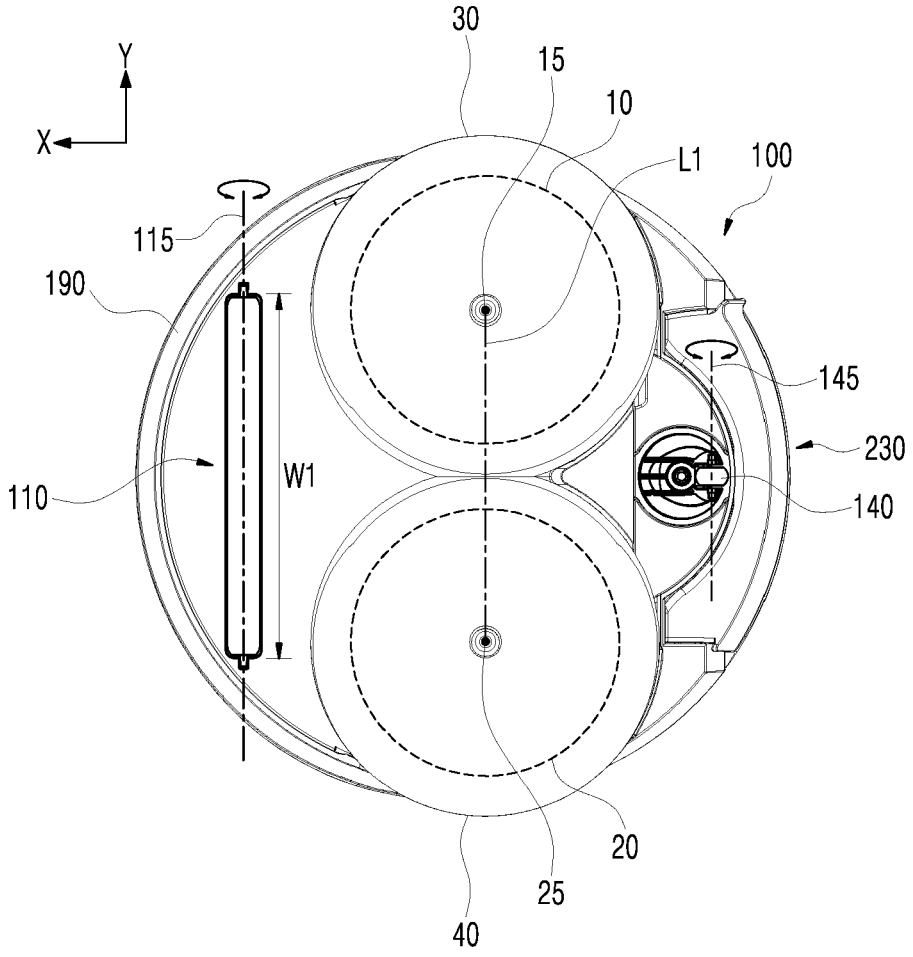
FIG. 5A is a diagram illustrating a bottom view of a cleaner according to an embodiment of the present disclosure, in which a first rotating plate and a second rotating plate are represented by dotted lines.
Figure 5B:
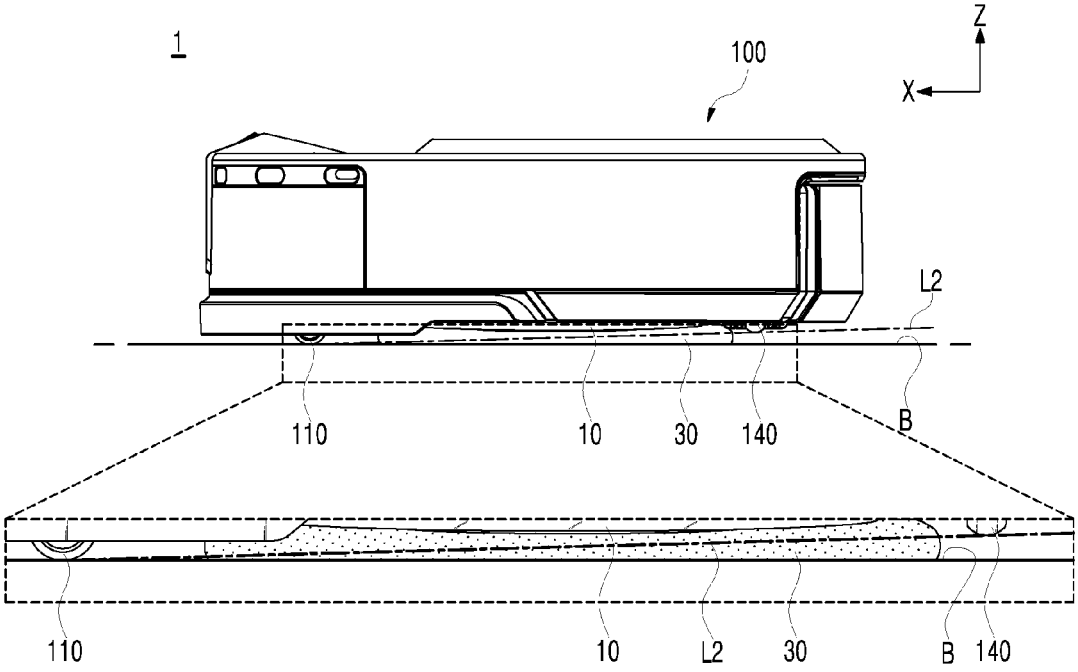
FIG. 5B is a diagram illustrating a side view of the cleaner shown in FIG. 5A along with an enlarged view of the lower portion of the cleaner.

FIG. 5A is a diagram illustrating a bottom view of the cleaner 1 according to another embodiment of the present disclosure, and FIG. 5B is a diagram illustrating a side view of the cleaner 1 shown in FIG. 5A. The cleaner 1 according to another embodiment of the present disclosure may include at least one support wheel (or front wheel) 110 and an auxiliary wheel (or rear wheel) 140.

The support wheel 110 may be coupled to the lower portion of the body 100 while being spaced apart from the first rotating plate 10 and the second rotating plate 20. The support wheel 110 may be formed as a common wheel. The support wheel 110 has a rotation axis formed to be parallel to the floor surface B. The support wheel 110 may move while rolling in contact with the floor. As a result, the cleaner 1 may move along the floor surface B. The support wheel 110 according to an embodiment of the present disclosure may contact the floor together with the first mop 30 and the second mop 40.

Considering the entire size of the cleaner 1, a width W1 of the support wheel 110 in the direction of the rotation axis may be formed to be relatively wide. More specifically, when the support wheel 110 is placed on the floor surface B (when the rotation axis of the support wheel 110 is parallel to the floor surface B), one support wheel 110 may be formed have a width W1 capable of supporting a part of the load of the cleaner 1 such that the cleaner 1 remains upright without falling sideways. For example, the support wheel 110 may be formed to have a shape such as a roller.

The auxiliary wheel 140 may be coupled to the lower portion of the body 100 while being spaced apart from the first rotating plate 10 and the second rotating plate 20. For example, the auxiliary wheel 140 may be positioned rear of the first rotating plate 10 and the second rotating plate 20. A connection line L1 connects the center of the first rotating plate 10 to the center of the second rotating plate 20 along a horizontal direction (e.g., in a direction parallel to the floor surface B), and the auxiliary wheel 140 and the support wheel 110 may be positioned at opposite sides of the bottom surface of the body 100 with respect to the connection line L1.

The auxiliary wheel 140 according to an embodiment of the present disclosure may be formed as an undriven wheel or caster. In another example, auxiliary wheel 140 may rotate autonomously based on receiving a driving force, such as from a motor. The auxiliary wheel 140 may have a rotation axis 145 formed parallel to the floor surface B. The auxiliary wheel 140 may move while rolling in contact with the floor. As a result, the cleaner 1 may move along the floor surface B while the auxiliary wheel rotates when selectively contacts when contacting the floor surface B. However, the auxiliary wheel 140 according to an embodiment of the present disclosure may not come into contact with the floor surface B when the first mop 30 and the second mop 40 a provided in the cleaner 1 to come into contact with the floor.

The cleaner 1 according to an embodiment of the present disclosure may be formed to move straight along the floor surface B. For example, the cleaner 1 may move straight in the forward direction (toward the X direction), or straight in the backward direction, such as to avoid an obstacle or a drop.

In the cleaner 1 according to an embodiment of the present disclosure, the lowest parts of the first rotating plate 10 and the second rotating plate 20 may be formed to be higher than a virtual reference line L2 connecting the lowest part of the support wheel 110 to the lowest part of the auxiliary wheel 140, and the lowest parts of the first mop 30 and the second mop 40 may be formed to be lower than the reference line L2. That is, in the cleaner 1 according to an embodiment of the present disclosure, the support wheel 110 and the auxiliary wheel 140 do not interfere with the contact of the first mop 30 and the second mop 40 with the floor when the first mop 30 is coupled to the first rotating plate 10 and the second mop 40 is coupled to the second rotating plate 20.

As a result, the first mop 30 and the second mop 40 may come into contact with the floor, and mopping, cleaning and movement of the cleaner 1 can be performed by rotation of the first mop 30 and the second mop 40. Here, the support wheel 110 and the auxiliary wheel 140 may be spaced apart from the floor when the first mop 30 and the second mop 40 contact the floor. Alternatively, the auxiliary wheel 140 may be spaced apart from the floor while the support wheel 110, the first mop 30, and the second mop 40 come into contact with the floor.

In an embodiment of the present disclosure, when the cleaner 1 is placed on the floor such that the first mop 30 and the second mop 40 are in contact with the floor, the height from the floor surface B to the lowest part of the support wheel 110 is formed to be lower than the height from the floor surface B to the lowest part of the auxiliary wheel 140. Further, when the first mop 30 and the second mop 40 are separated from the first rotating plate 10 and the second rotating plate 20, the support wheel 110 and the auxiliary wheel 140 may contact the floor, and lower surfaces of the first rotating plate 10 and the second rotating plate 20 may be spaced apart from the floor.

When the first mop 30 and the second mop 40 are separated and the cleaner 1 is operated (e.g., rotation of the first rotating plate 10 and the second rotating plate 20 is performed unintendedly), the configuration of cleaner 1 helps to prevent the first rotating plate 10 and the second rotating plate 20 from coming into contact with the floor and rubbing against the floor. As a result, damage to the first rotating plate 10 and the second rotating plate 20 may be avoided, and damage to the floor may be avoided. In addition, even when the cleaner 1 unintendedly moves on the floor in this state, as the support wheel 110 and the auxiliary wheel 140 can move while rolling on the floor, the present disclosure may provide an effect of preventing the floor from being scratched, and effectively avoiding damage being caused to the cleaner 1 or the floor.

Figure 6:
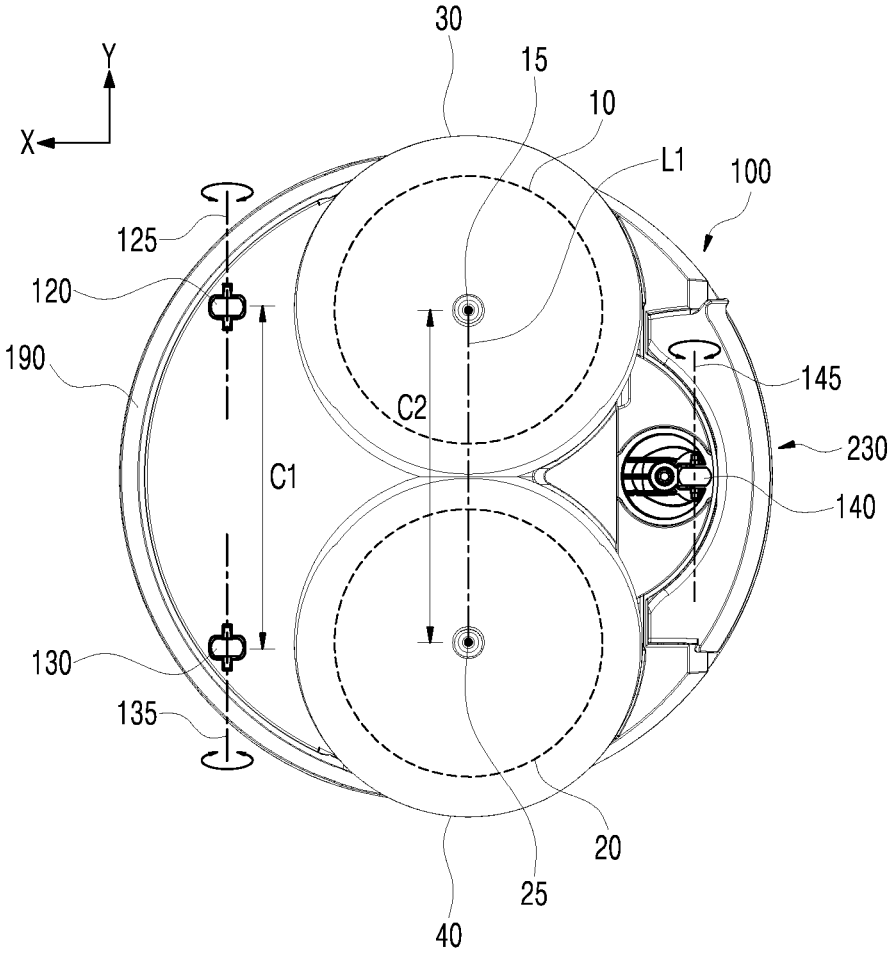
FIG. 6 is a diagram illustrating a bottom view of a cleaner according to an embodiment of the present disclosure, in which a first rotating plate and a second rotating plate are represented by dotted lines.
Figure 7A:
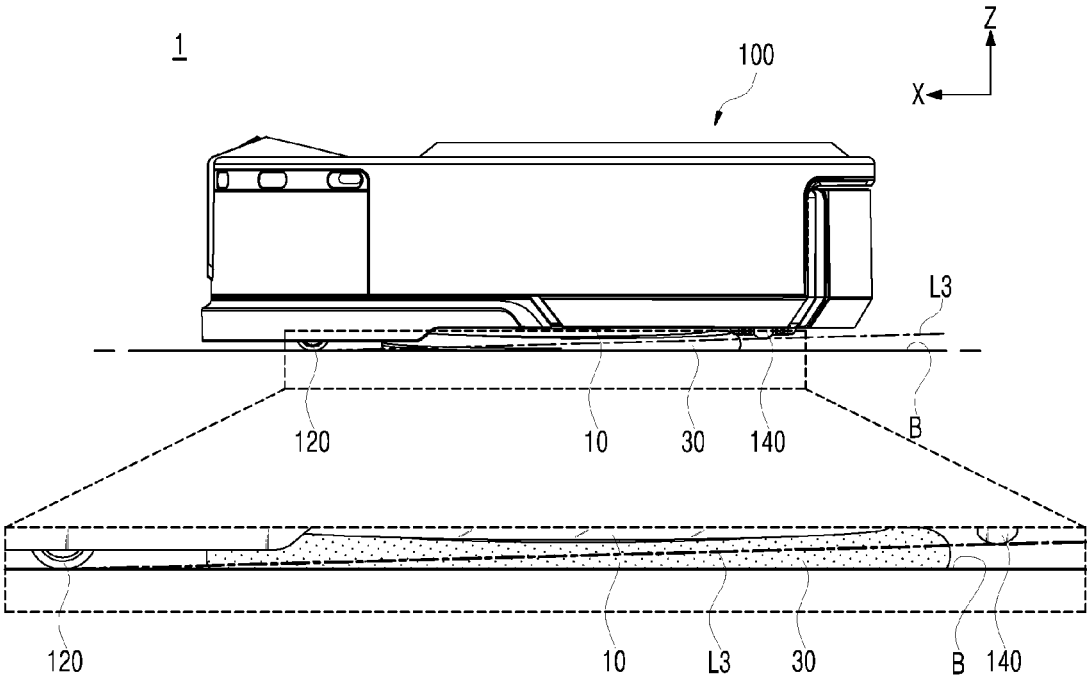
FIGS. 7A and 7B are diagrams illustrating a side view of the cleaner shown in FIG. 6 along with an enlarged view of the lower portion of the cleaner.
Figure 7B:
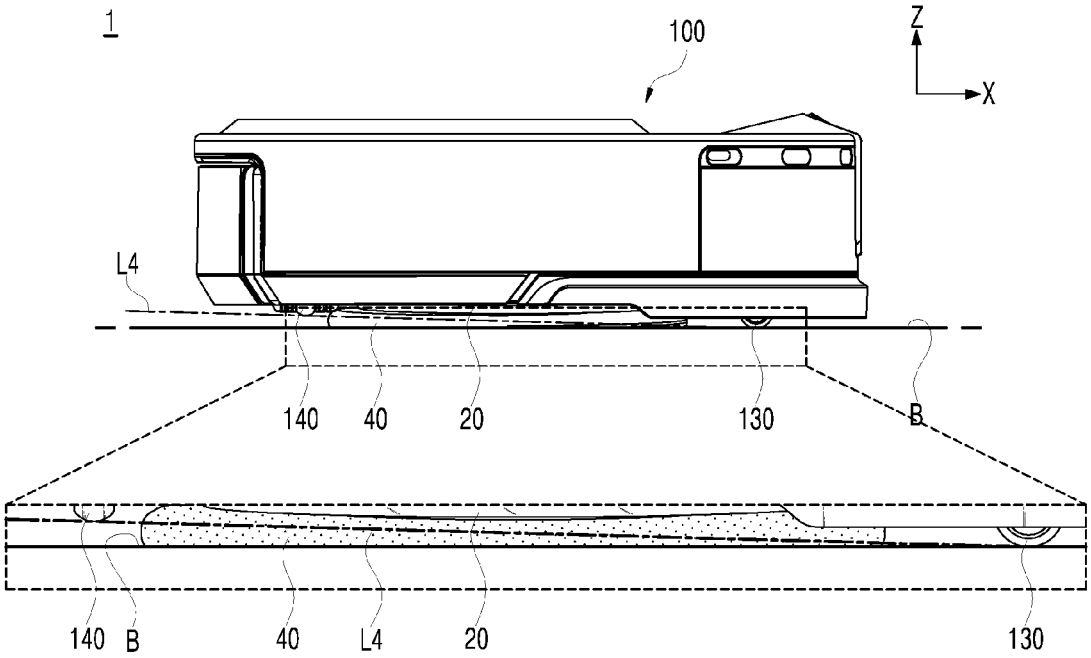
Figure 8A:
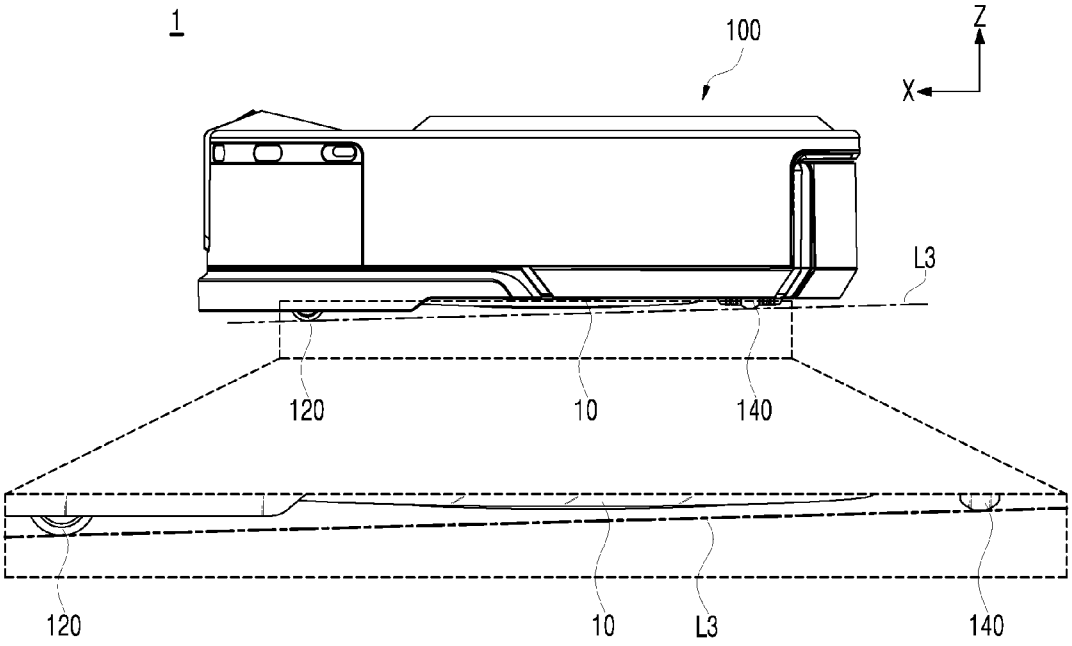
FIGS. 8A and 8B are diagrams illustrating a side view of the cleaner while excluding a partial configuration of the cleaner shown in FIG. 6, along with an enlarged view of the lower portion of the cleaner.
Figure 8B:
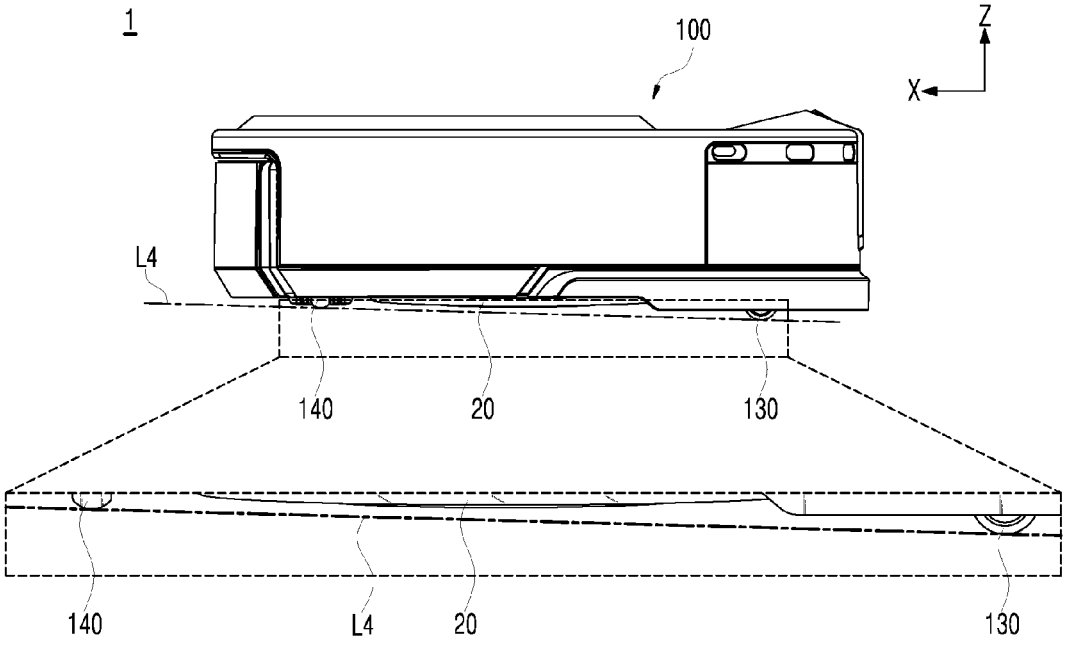

FIG. 6 is a diagram illustrating a bottom view of the cleaner 1 according to still another embodiment of the present disclosure. FIGS. 7A and 7B are diagrams illustrating a side view of the cleaner 1 shown in FIG. 6. FIGS. 8A and 8B are diagrams illustrating a side view of the cleaner 1 while excluding a partial configuration of the cleaner shown in FIG. 6. The cleaner 1 according to an embodiment of the present disclosure may include a first support wheel (or first or left front wheel) 120, a second support wheel (or second or right front wheel) 130, and an auxiliary wheel (or rear wheel) 140. The auxiliary wheel 140 may be formed as described above.

In an embodiment of the present disclosure, the first support wheel 120 and the second support wheel 130 are spaced apart from each other, and may be formed as common (e.g., undriven) wheels. The first support wheel 120 and the second support wheel 130 may move while rolling in contact with the floor. As a result, the cleaner 1 may move along the floor surface B. The first support wheel 120 may be coupled to the bottom surface of the body 100 at a position spaced apart from the first rotating plate 10 and the second rotating plate 20, and the second support wheel 130 may also be coupled to the bottom surface of the body 100 at a position spaced apart from the first rotating plate 10 and the second rotating plate 20.

The second support wheel 130 is disposed at the same side as the first support wheel 120 (e.g., at a front of the body 100) with respect to the aforementioned connection line L1. Here, the auxiliary wheel 140 may be disposed at the opposite side to the first support wheel 120 with respect to the connection line L1. That is, the first support wheel 120 and the second support wheel 130 may be disposed in front of the connection line L1, and the auxiliary wheel 140 may be disposed behind the connection line L1.

Considering the entire size of the cleaner 1, a space between the first support wheel 120 and the second support wheel 130 may be formed to be relatively wide. For example, when the first support wheel 120 and the second support wheel 130 are placed on the floor surface B (when the rotation axis 125 of the first support wheel 120 and the rotation axis 135 of the second support wheel 130 are substantially parallel to the floor surface B), the first support wheel 120 and the second support wheel 130 may be spaced apart and support at least a part of the load of the cleaner 1 such that the cleaner 1 remains upright without falling sideways.

The first support wheel 120 may be disposed in front of the first rotating plate 10, and the second support wheel 130 may be disposed in front of the second rotating plate 20. In the cleaner 1 according to an embodiment of the present disclosure, the first rotating plate 10 and the second rotating plate 20 may be (bilaterally) symmetrical to each other, and the first support wheel 120 and the second support wheel 130 may be (bilaterally) symmetrical to each other.

In the cleaner 1 according to an embodiment of the present disclosure, the lowest part of the first rotating plate 10 may be formed to be higher than a first virtual reference line L3 connecting the lowest part of the first support wheel 120 to the lowest part of the auxiliary wheel 140, and the lowest part of the first mop 30 may be formed to be lower than the first reference line L3 (see FIG. 8A). Also, the lowest part of the second rotating plate 20 may be formed to be higher than a second virtual reference line L4 connecting the lowest part of the second support wheel 130 to the lowest part of the auxiliary wheel 140, and the lowest part of the second mop 40 may be formed to be lower than the second reference line L4 (see FIG. 8B).

That is, in the cleaner 1 according to an embodiment of the present disclosure, the first support wheel 120, the second support wheel 130, and the auxiliary wheel 140 do not interfere with the contact of the first mop 30 and the second mop 40 with the floor when the first mop 30 is coupled to the first rotating plate 10 and the second mop 40 is coupled to the second rotating plate 20. As a result, the first mop 30 and the second mop 40 may come into contact with the floor, and mopping and cleaning can be performed by rotation of the first mop 30 and the second mop 40. Here, the first support wheel 120, the second support wheel 130 and the auxiliary wheel 140 may be spaced apart from the floor. Alternatively, the auxiliary wheel 140 may be spaced apart from the floor while the first support wheel 120 and the second support wheel 130 come into contact with the floor while the first mop 30 and the second mop 40 contact the floor.

In an embodiment of the present disclosure, when the cleaner 1 is placed on the floor such that the first mop 30 and the second mop 40 are in contact with the floor, the heights from the floor surface B to the lowest part of the first support wheel 120 and from the floor surface B to the lowest part of the second support wheel 130 may be lower than the height from the floor surface B to the lowest part of the auxiliary wheel 140. Further, when the first mop 30 and the second mop 40 are separated from the first rotating plate 10 and the second rotating plate 20, the first support wheel 120, the second support wheel 130 and the auxiliary wheel 140 may contact the floor, and the first rotating plate 10 and the second rotating plate 20 may be spaced apart from the floor (see FIGS. 8A and 8B).

In this state, the cleaner 1 is operated such that the first rotating plate 10 and the second rotating plate 20 rotate, the cleaner 1 is capable of preventing the first rotating plate 10 and the second rotating plate 20 from coming into contact with the floor and rubbing against the floor. As a result, damage to the first rotating plate 10 and the second rotating plate 20 may be avoided, and damage to the floor may be avoided. In addition, even when the cleaner 1 unintendedly moves on the floor in this state, the first support wheel 120, the second support wheel 130, and the auxiliary wheel 140 can easily roll on the floor, thereby preventing the floor from being scratched, and effectively avoiding damage to the cleaner 1 or the floor.

Figure 9:
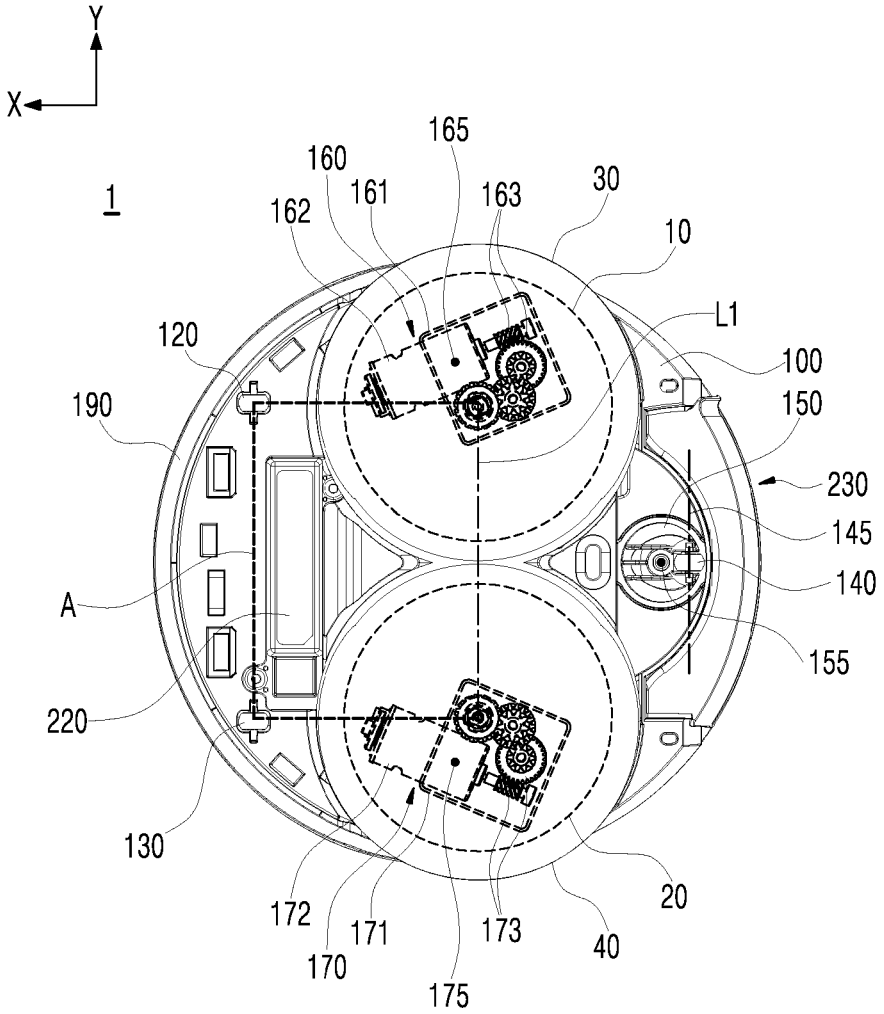
FIG. 9 is a diagram illustrating a bottom view of a cleaner according to an embodiment of the present disclosure, in which a first rotating plate, a second rotating plate, a first actuator, and a second actuator are represented by dotted lines.
Figure 10:
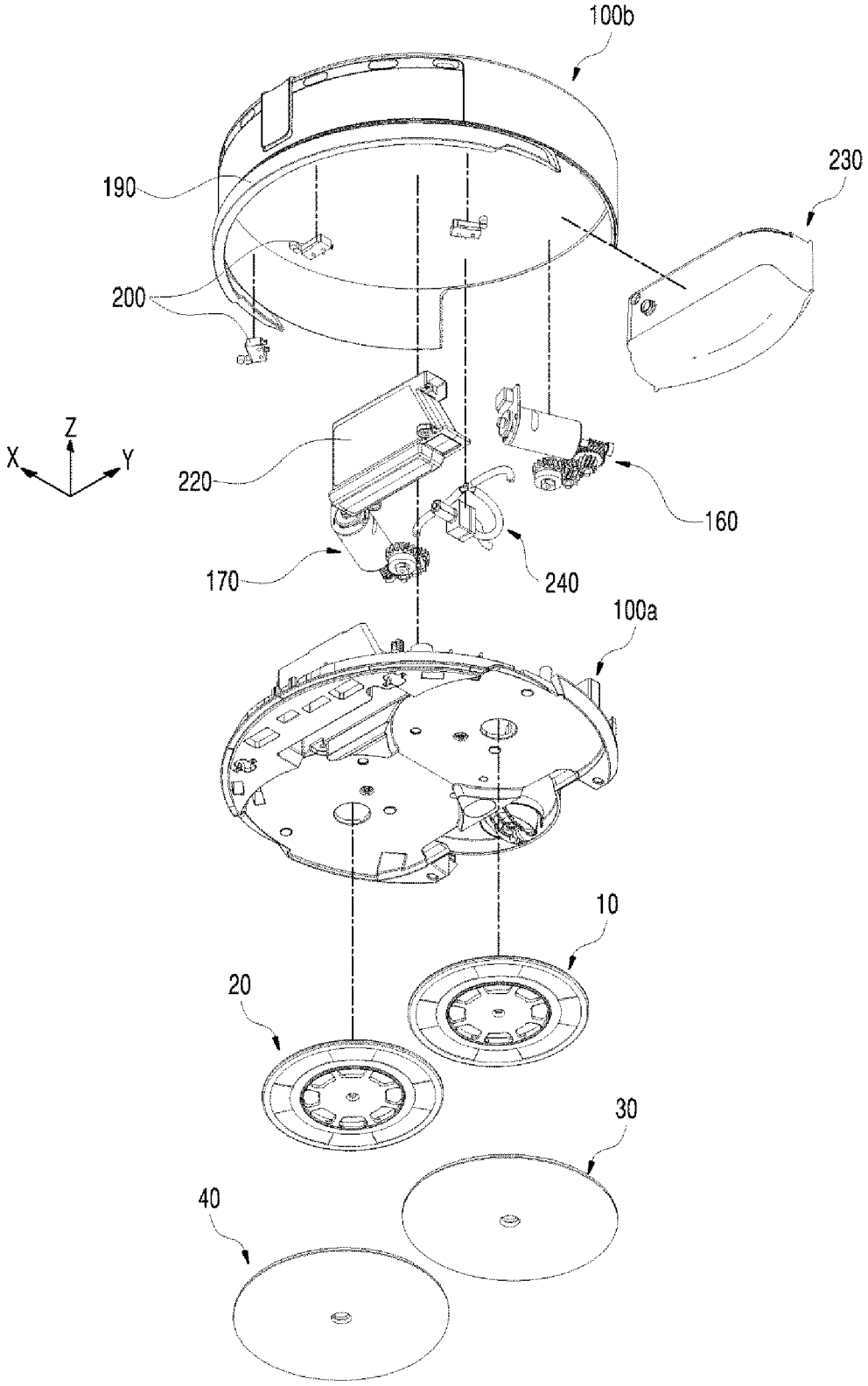
FIG. 10 is a diagram illustrating an exploded perspective view of the cleaner shown in FIG. 9.

FIG. 9 is a diagram illustrating a bottom view of the cleaner 1 according to still another embodiment of the present disclosure, and FIG. 10 is a diagram illustrating an exploded perspective view of the cleaner 1 shown in FIG. 9. The cleaner 1 according to an embodiment of the present invention may include a first actuator 160, a second actuator 170, a battery 220, a water bottle 230, and a water supply tube 240.

The first actuator 160 may be coupled to the body 100 to rotate the first rotating plate 10. The first actuator 160 may include a first case 161, a first motor 162, and one or more first gears 163. The first case 161 may support the components constituting the first actuator 160 and may be fixedly coupled to the body 100. The first motor 162 may be formed as an electric motor.

A plurality of first gears 163 may be formed to rotate while being engaged with each other. The first gears 163 may connect the first motor 162 to the first rotating plate 10 and may transmit rotational power of the first motor 162 to the first rotating plate 10. As a result, the first rotating plate 10 may rotate upon rotation of the rotation axis of the first motor 162.

The second actuator 170 may be coupled to the body 100 to rotate the second rotating plate 20. The second actuator 170 may include a second case 171, a second motor 172, and one or more second gears 173. The second case 171 may support the components constituting the second actuator 170 and may be fixedly coupled to the body 100. The second motor 172 may be formed as an electric motor.

A plurality of second gears 173 may be formed to rotate while being engaged with each other. The second gears 173 may connect the second motor 172 to the second rotating plate 20 and may transmit rotation power of the second motor 172 to the second rotating plate 20. As a result, the second rotating plate 20 may be rotate upon rotation of the rotation axis of the second motor 172. Likewise, in the cleaner 1 according to an embodiment of the present disclosure, the first rotating plate 10 and the first mop 30 may rotate by the operation of the first actuator 160, and the second rotating plate 20 and the second mop 40 may rotate by the operation of the second actuator 170.

In an embodiment of the present disclosure, the first actuator 160 may have a center of gravity 165 located inside a vertical area formed by the first rotating plate 10. That is, by disposing the first actuator 160 directly on the first rotating plate 10, loss of power transmitted from the first actuator 160 to the first rotating plate 10 may be minimized, and by applying a relatively heavy load of the first actuator 160 to the first rotating plate 10, the first mop 30 may mop the floor while rubbing the floor.

Further, in an embodiment of the present disclosure, the second actuator 170 may have a center of gravity 175 located inside a vertical area formed by the second rotating plate 20. That is, by disposing the second actuator 170 directly on the second rotating plate 20, loss of power transmitted from the second actuator 170 to the second rotating plate 20 may be minimized, and by applying a relatively heavy load of the second actuator 170 to the second rotating plate 20, the second mop 40 may mop the floor while rubbing the floor. The second actuator 170 may be formed to be (bilaterally) symmetrical to the first actuator 160 with respect to a front-to-rear midline of the body 100.

The battery 220 may be coupled to the body 100 and may supply power to other components of the cleaner 1. The battery 220 may supply power to the first actuator 160 and the second actuator 170, and particularly, the battery 220 may supply power to the first motor 162 and the second motor 172. In an embodiment of the present disclosure, the battery 220 may be charged by an external power source, and for this purpose, one side of the body 100 or the battery 220 itself may include a charging terminal for charging the battery 220.

In the cleaner 1 according to an embodiment of the present disclosure, the battery 220 may be located inside a rectangular vertical area A formed using a center of the first rotating plate 10 (e.g., rotational axis 15), the center of the second rotating plate 20 (e.g., rotational axis 25), the center of the first support wheel 120, and the center of the second support wheel 130 as the respective vertices. That is, the battery 220 may be disposed in front of the connection line L1 and rear of a line extending between first and second supports wheels 120, 130. In the cleaner 1 according to an embodiment of the present disclosure, the battery 220 may be coupled to the body 100 such that the longitudinal direction thereof is parallel to the connection line L1.

The water bottle (or liquid container) 230 may be formed as a container having an inner space such that a liquid, such as water, can be stored therein. The water bottle 230 may be fixedly coupled to the body 100 or may be detachably attached to the body 100. In an embodiment of the present disclosure, the water bottle 230 may be located behind the connection line L1, and the water bottle 230 may be located above an auxiliary wheel 140.

The water supply tube 240 may be formed as a tube or pipe and may be connected to the water bottle 230 such that the liquid in the water bottle 230 flows through the inside of the water supply tube 240. The water supply tube 240 may have an input end portion disposed at the opposite side connected to the water bottle 230. The end portion of the water supply tube 240 is disposed above the first rotating plate 10 and the second rotating plate 20 so that liquid in the water bottle 230 may be supplied to the first mop 30 and the second mop 40.

In the cleaner 1 according to an embodiment of the present disclosure, the water supply tube 240 may be formed as one pipe that is branched into two end outlets. One end portion of the branched pipe may be disposed above the first rotating plate 10, and the other end portion of the branched pipe may be disposed above the second rotating plate 20. In the cleaner 1 according to an embodiment of the present disclosure, a separate pump may be disposed to move liquid through the water supply tube 240.

The center of gravity of the cleaner 1 may be located inside a rectangular vertical area A formed using the center of the first rotating plate 10, the center of the second rotating plate 20, the center of the first support wheel 120, and the center of the second support wheel 130 as the respective vertices. In the cleaner 1 according to an embodiment of the present disclosure, each of the first actuator 160, the second actuator 170, the battery 220, and the water bottle 230 may be relatively heavy in the cleaner 1. Accordingly, the first actuator 160 and the second actuator 170 may be located on the connection line L1 or adjacent to the connection line L1, the battery 220 may be located in front of the connection line L1, and the water bottle 230 may be located behind the connection line L1, so that the overall center of gravity of the cleaner 1 may be located at the center of the cleaner 1. Accordingly, the first mop 30 and the second mop 40 may be in stable contact with the floor. In addition, since the first actuator 160, the second actuator 170, the battery 220 and the water bottle 230 are each located on different areas in the plan view, it is possible to form a relatively flat body 100 and cleaner 1, and it is possible to form a cleaner 1 that is easily able to enter a space under a shelf or a table.

In addition, according to the cleaner 1 according to an embodiment of the present disclosure, when the cleaner 1 operated while the water bottle 230 is substantially full with a liquid, the weight in the cleaner can be distributed evenly such that cleaning is performed while only the first mop 30 and the second mop 40 contact the floor. Here, when the center of gravity of the cleaner 1 moves forward as the liquid inside the water bottle 230 is consumed, cleaning may be performed while the first mop 30 and the second mop 40 contact the floor together with the first support wheel 120 and the second support wheel 130. For example, as previously described, the water bottle 230 may be positioned at a rear of the cleaner 1, and as the liquid is used, a center of weight of the cleaner may move forward.

Figure 11:
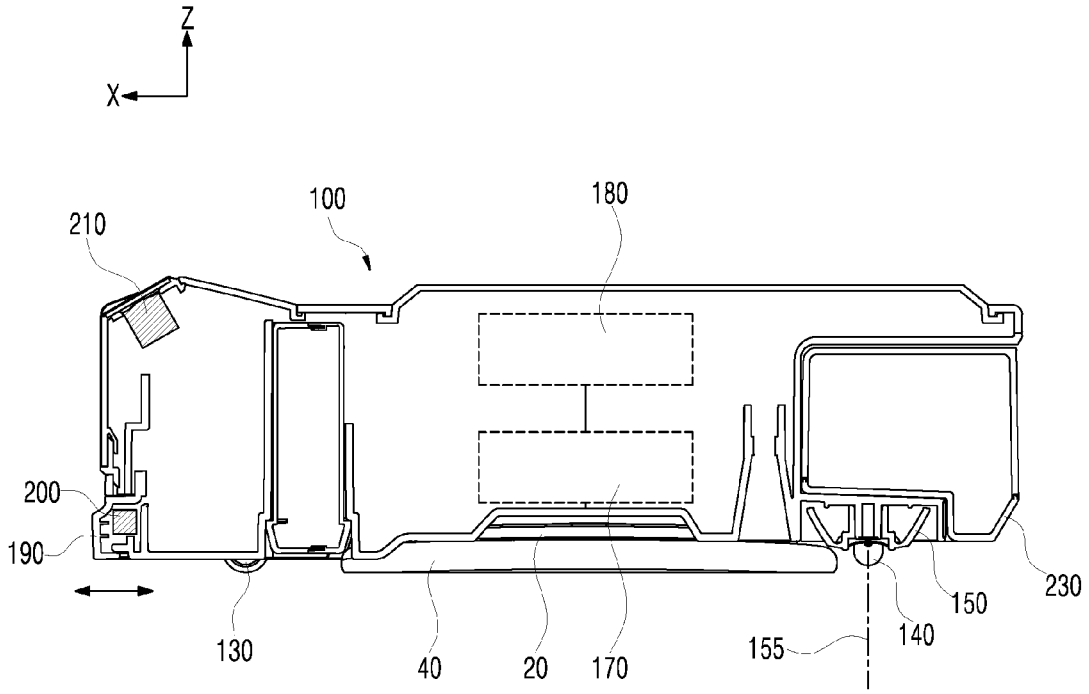
FIG. 11 is a cross-sectional diagram schematically illustrating a cleaner and components thereof according to an embodiment of the present disclosure.

FIG. 11 is a cross-sectional diagram schematically illustrating the cleaner 1 and components thereof according to still another embodiment of the present disclosure. The cleaner 1 according to an embodiment of the present disclosure may include a controller 180, a bumper 190, a first sensor (or bumper motion sensor) 200, and a second sensor (or obstacle sensor) 210. The controller 180 may be configured to control the operation of the first actuator 160 and the second actuator 170 based on predetermined information or real-time information. In order to control the controller 180, the cleaner 1 may include a storage medium in which an application program is stored. The controller 180 may be configured to control the cleaner 1 by driving the application program according to information inputted to the cleaner 1 and information outputted from the cleaner.

The bumper 190 may be coupled to the body 100 along the edge thereof, and may be configured to move relative to the body 100. For example, the bumper 190 may be coupled to the body 100 so as to reciprocate in a direction toward the center of the body 100. The bumper 190 may be coupled along a portion of the edge of the body 100, or may be coupled along the entire edge of the body 100.

The first sensor 200 is coupled to the body 100, and may be configured to detect movement (e.g., a relative movement) of the bumper 190 with respect to the body 100. The first sensor 200 may include, for example, a microswitch, a photo interrupter, or a tact switch. In other examples, the first sensor 200 may detect an impact to the bumper 190, and may include, for example, an inertia sensor such as a gyroscope.

The controller 180 may control the cleaner 1 to avoid an obstacle when the bumper 190 of the cleaner 1 comes into contact with the obstacle, and may control the operation of the first actuator 160 and/or the second actuator 170 based on information obtained by the first sensor 200. For example, when the bumper 190 comes into contact with an obstacle while the cleaner 1 is traveling, the position where the bumper 190 contacts may be recognized by the first sensor 200, and the controller 180 may control the operation of the first actuator 160 and/or the second actuator 170 such that the cleaner 1 moves away from the contact position.

The second sensor 210 may be coupled to the body 100, and configured to detect a relative distance from the obstacle. The second sensor 210 may be a distance sensor such as a LIDAR. The controller 180 may control the operation of the first actuator 160 and/or the second actuator 170 such that the cleaner 1 changes its traveling direction or moves away from an obstacle when the distance between the cleaner 1 and the obstacle is less than a predetermined value based on information obtained by the second sensor 210.

Figure 12:
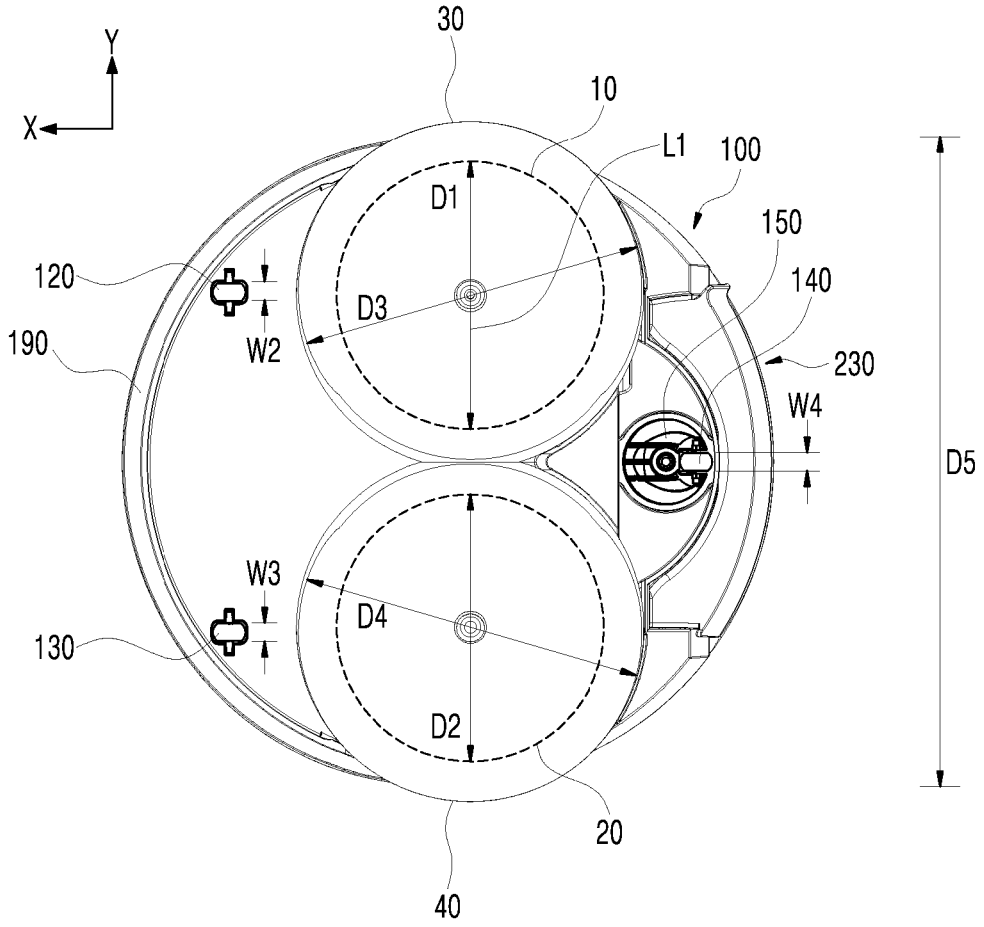
FIG. 12 is a diagram illustrating the size of each component in the cleaner shown in FIG. 6.

FIG. 12 is a diagram illustrating the size of each component in the cleaner 1 shown in FIG. 6. As described above, the cleaner 1 according to an embodiment of the present disclosure may move according to the frictional force between the first mop 30 and the floor surface B, which is generated when the first rotating plate 10 rotates, and the frictional force between the second mop 40 and the floor surface B, which is generated when the second rotating plate 20 rotates.

In the cleaner 1 according to an embodiment of the present disclosure, the first support wheel 120 and the second support wheel 130 may be formed such that the movement (travelling) of the cleaner 1 is not interfered with by the friction with the floor and no increase in load is caused when the cleaner 1 moves (travels). To this end, a width W2 of the first support wheel 120 and a width W3 of the second support wheel 130 may be significantly smaller than a diameter D1 of the first rotating plate 10 or a diameter D2 of the second rotating plate 20 such that friction forces generated by the first support wheel 120 and the second support wheel 130 are relatively small. For example, the width W2 of the first support wheel 120 and the width W3 of the second support wheel 130 may be smaller than 1/10 of the diameter D1 of the first rotating plate 10 or the diameter D2 of the second rotating plate 20.

Further, each of the diameter D1 of the first rotating plate 10 and the diameter D2 of the second rotating plate 20 may be greater than 1/3 and smaller than 1/2 of a diameter D5 of the body 100. Each of a diameter D3 of the first mop 30 and a diameter D4 of the second mop 40 may be larger than 1/3 and smaller than 2/3 of the diameter D5 of the body 100. As such, even when the cleaner 1 is driven while the first support wheel 120 and the second support wheel 130 are in contact with the floor together with the first mop 30 and the second mop 40, the frictional force between the first support wheel 120 and the floor surface B and the frictional force between the second support wheel 130 and the floor surface B may be made to be significantly smaller than the frictional force between the first mop 30 and the floor surface B and the frictional force between the second mop 40 and the floor surface B, thereby not causing unnecessary power loss and not hindering the movement of the cleaner 1.

In the cleaner 1 according to an embodiment of the present disclosure, a horizontal distance C1 between the center of the first support wheel 120 and the center of the second support wheel 130 may be formed to be identical to or similar to a horizontal distance C2 between the center of rotation of the first rotating plate 10 and the center of rotation of the second rotating plate 20 (see FIG. 6). C2 may correspond to a length of L1 between first and second rotational axes 15 and 25. When the horizontal distance between the center of the first support wheel 120 and the center of the second support wheel 130 is C1 and the distance between the center of rotation of the first rotating plate 10 and the center of rotation of the second rotation plate 20 is C2, C1 may be greater than 0.8*C2 and smaller than 1.2*C2. As a result, the cleaner 1 according to an embodiment of the present disclosure may be stably supported at four points by the first support wheel 120, the second support wheel 130, the first mop 30, and the second mop 40.

In the cleaner 1 according to an embodiment of the present disclosure, the rotation axis 125 of the first support wheel 120 and the rotation axis 135 of the second support wheel 130 may be parallel to the connection line L1. That is, the rotation axis 125 of the first support wheel 120 and the rotation axis 135 of the second support wheel 130 may be fixed (fixed bilaterally) to the body 100.

The first support wheel 120 and the second support wheel 130 may be in contact with the floor together with the first mop 30 and the second mop 40. In order to move the cleaner 1 in a straight line, the first mop 30 and the second mop 40 may rotate at a substantially same speed in opposing directions to each other. Herein, the first support wheel 120 and the second support wheel 130 assists in moving the cleaner 1 in a straight line in the front and rear directions.

The cleaner 1 according to an embodiment of the present disclosure may include an auxiliary wheel body (or rear wheel frame) 150. Here, the auxiliary wheel body 150 may be rotatably coupled to the lower portion of the body 100, and the auxiliary wheel 140 may be rotatably coupled to the auxiliary wheel body 150. That is, the auxiliary wheel 140 may be coupled to the body 100 via the auxiliary wheel body 150.

The rotation axis 145 of the auxiliary wheel 140 may be formed to intersect a rotation axis 155 of the auxiliary wheel body 150. The rotation axis 145 of the auxiliary wheel 140 may be perpendicular to the rotation axis 155 of the auxiliary wheel body 150. For example, the rotation axis 155 of the auxiliary wheel body 150 may be directed in the vertical direction or be slightly inclined in the vertical direction, and the rotation axis 145 of the auxiliary 140 may be directed in the horizontal direction.

In the cleaner 1 according to an embodiment of the present disclosure, the auxiliary wheel 140 may come into contact with the floor surface B when the cleaner 1 is not practically being used for cleaning or movement (e.g., when the first mop 30 and the second mop 40 are separated from the cleaner 1). When the cleaner 1 enters this state, the direction in which the auxiliary wheel 140 is directed by the auxiliary wheel body 150 may be freely changed, and the cleaner 1 may be easily moved.

An aspect of the present disclosure is to provide a cleaner equipped with a pair of mops that rotate in contact with the floor, capable of preventing the cleaner from being damaged or the floor from being damaged even when the cleaner is operated in a separated state in which the mops are separated from the cleaner. Another aspect of the present disclosure is to provide a cleaner in which mops come into intensive contact with the floor when the mops are coupled to the cleaner, and parts coupled to the mops are spaced apart from the floor when the mops are separated from the cleaner.

Still another aspect of the present disclosure is to provide a cleaner equipped with a water bottle configured to supply liquid (water) to a pair of mops, capable of facilitating stable contact and friction between the mops and the floor when the entire center of gravity of the cleaner changes in accordance with consumption of the liquid, even when the water bottle is not disposed at the center of gravity of the cleaner. Still another aspect of the present disclosure is to provide a cleaner capable of facilitating stable mopping even when a motor, a battery, and a water bottle are respectively disposed at different positions so as to form a relatively flat cleaner. Still another aspect of the present disclosure is to provide a cleaner in which a traveling direction of the cleaner can be controlled by a pair of mops rotating in contact with the floor, and that includes an auxiliary means for controlling the traveling direction of the cleaner.

A cleaner according to an embodiment of the present disclosure includes a body, a first rotating plate, a second rotating plate, a first mop, and a second mop. The cleaner according to an embodiment of the present disclosure may be made to move automatically even when no separate external force is applied. That is, the cleaner according to an embodiment of the present disclosure may be made to move like a common 'robot cleaner.' The body may form the overall exterior of the cleaner or be formed as a frame to which other components of the cleaner are coupled.

Each of the first rotating plate and the second rotating plate are rotatably coupled to the body. The first rotating plate may be coupled to the lower portion of the body, and the second rotating plate may also be coupled to the lower portion of the body. The first mop may be detachably attached to a bottom surface of the first rotating plate and may be coupled to the first rotating plate to rotate with the first rotating plate. The second mop may be detachably attached to the bottom surface of the second rotating plate and may be coupled to the second rotating plate to rotate with the second rotating plate.

In the cleaner according to an embodiment of the present disclosure, the first mop and the second mop come into contact with the floor when the first mop is coupled to the first rotating plate and the second mop is coupled to the second rotating plate, and the first rotating plate and the second rotating plate are spaced apart from the floor when the first mop and the second mop are separated from the first rotating plate and the second rotating plate. To this end, the cleaner includes a supporting means.

The cleaner according to an embodiment of the present disclosure may include a support wheel and an auxiliary wheel as the supporting means. Further, the cleaner according to an embodiment of the present disclosure may include a first support wheel, a second support wheel, and an auxiliary wheel as the supporting means. The support wheel may be coupled to the lower portion of the body. The auxiliary wheel may also be coupled to the lower portion of the body.

In the cleaner according to an embodiment of the present disclosure, the auxiliary wheel may be disposed at the opposite side of the support wheel with respect to a virtual connection line connecting the center of the first rotating plate to the center of the second rotating plate. In the cleaner according to an embodiment of the present disclosure, the lowest part of the first rotating plate and the lowest part of the second rotating plate may be higher than a virtual reference line connecting the lowest part of the support wheel to the lowest part of the auxiliary wheel, and the lowest part of the first mop and the lowest part of the second mop may be lower than the reference line.

The first support wheel may be coupled to the lower portion of the body. The second support wheel may be spaced apart from the first support wheel and coupled to the body at the same side of the first support wheel with respect to the connection line. The first support wheel may be disposed to be closer to the first rotating plate than the second rotating plate, and the second support wheel may be disposed to be closer to the second rotating plate than the first rotating plate.

The first support wheel may be coupled to the body in front of the first rotating plate, and the second support wheel may be coupled to the body in front of the second rotating plate. The auxiliary wheel may be coupled to the body at the other side of the first support wheel with respect to the connection line. The auxiliary wheel may be coupled to the body behind the center of the first rotating plate and the center of the second rotating plate.

In the cleaner according to an embodiment of the present disclosure, the lowest part of the first rotating plate may be higher than a first virtual reference line connecting the lowest part of the first support wheel to the lowest part of the auxiliary wheel, and the lowest part of the first mop may be lower than the first reference line. In the cleaner according to an embodiment of the present disclosure, the lowest part of the second rotating plate may be higher than a second virtual reference line connecting the lowest part of the second support wheel to the lowest part of the auxiliary wheel, and the lowest part of the second mop may be lower than the second reference line.

In the cleaner according to an embodiment of the present disclosure, the first rotating plate and the second rotating plate may be symmetrical to each other, and the first support wheel and the second support wheel may be symmetrical to each other. In cleaner according to an embodiment of the present disclosure, the first support wheel, the second support wheel, and the auxiliary wheel may respectively be disposed so as not to interrupt movement (traveling) of the cleaner by a frictional force with the floor, and not to cause a load increase when the cleaner moves.

In the cleaner according to an embodiment of the present disclosure, the width of each of the first support wheel, the second support wheel, and the auxiliary wheel may be formed to be significantly small in comparison to a diameter of the first rotating plate or a diameter of the second rotating plate. In the cleaner according to an embodiment of the present disclosure, the width of each of the first support wheel, the second support wheel, and the auxiliary wheel may be formed to be smaller than 1/10 of the diameter of the first rotating plate or the diameter of the second rotating plate.

The diameter of each of the first rotating plate and the second rotating plate may be formed to be greater than 1/3 of the diameter of the body and smaller than 1/2 of the diameter of the body. The diameter of each of the first mop and the second mop may be formed to be greater than 1/3 of the diameter of the body and smaller than 2/3 of the diameter of the body.

In the cleaner according to an embodiment of the present disclosure, the first support wheel and the second support wheel and the first mop and the second mop may be disposed at such a distance with respect to each other that the cleaner may be stably supported thereby at four points. In the cleaner according to an embodiment of the present disclosure, when a horizontal distance between the center of the first support wheel and the center of the second support wheel is C1 and a distance between the center of rotation of the first rotating plate and the center of rotation of the second rotating plate is C2, C1 may be greater than 0.8*C2 and smaller than 1.2*C2. The cleaner according to an embodiment of the present disclosure is configured such that, when coming into contact with the floor, the first support wheel and the second support wheel and the first mop and the second mop assist in forward movement of the cleaner.

In the cleaner according to an embodiment of the present disclosure, a rotation axis of the first support wheel and a rotation axis of the second support wheel may be formed to be parallel to a virtual connection line connecting the rotation axis of the first rotating plate to the rotation axis of the second rotating plate. In the cleaner according to an embodiment of the present disclosure, the auxiliary wheel may be coupled to the body via an auxiliary wheel body that is rotatably coupled to the lower portion of the body, and a rotation axis of the auxiliary wheel and a rotation axis of the auxiliary wheel body may be formed to intersect each other.

In the cleaner according to an embodiment of the present disclosure, the center of gravity of the cleaner may be located inside a rectangular vertical area formed using the center of the first rotating plate, the center of the second rotating plate, the center of the first support wheel, and the center of the second support wheel as the respective vertices. The cleaner according to an embodiment of the present disclosure may be supported at four points by the first mop, the second mop, the first support wheel, and the second support wheel.

In the cleaner according to an embodiment of the present disclosure, the first rotating plate and the second rotating plate may be inclined with respect to the connection line such that the sides of the first rotating plate and the second rotating plate that are closer to each other are spaced further apart from the floor surface than the sides of the first rotating plate and the second rotating plate that are farther from each other.

The cleaner according to an embodiment of the present disclosure may further include a water bottle and a water supply tube. The water bottle is formed as a container so as to store liquid therein, and is coupled to the body. The water supply tube is formed as a tube or a pipe, and is connected to the water bottle so as to supply liquid in the water bottle to the first mop and the second mop. The water bottle may be disposed above the auxiliary wheel.

The cleaner according to an embodiment of the present disclosure may further include a first actuator, a second actuator, and a battery. The first actuator may be coupled to the body to rotate the first rotating plate. The first actuator may have a center of gravity located inside a vertical area formed by the first rotating plate. The second actuator may be disposed in the body to rotate the second rotating plate. The second actuator may have a center of gravity located inside a vertical area formed by the second rotating plate.

The battery may be coupled to the body to supply a power source to the first actuator and the second actuator, and may be disposed in a rectangular vertical area formed using the center of the first rotating plate, the center of the second rotating plate, the center of the first support wheel, and the center of the second support wheel as the respective vertices.

The cleaner according to an embodiment of the present disclosure may further include a controller configured to control the operation of the first actuator and the second actuator based on predetermined information or real-time information. The cleaner according to an embodiment of the present disclosure may further include a bumper, a first sensor, and a second sensor. The bumper may be coupled along the edge of the body so as to move relative to the body. The first sensor may be coupled to the body, and may sense the movement of the bumper relative to the body. The controller may be configured to control the operation of the first actuator and the second actuator based on information of the first sensor. The second sensor may be coupled to the body, and may sense a relative distance from an obstacle. The controller may be configured to control the operation of the first actuator and the second actuator based on information of the second sensor.

According to embodiments of the present disclosure, the cleaner includes the support wheel (the first support wheel and the second support wheel) and the auxiliary wheel, in which the lowest parts of the first rotating plate and the second rotating plate are higher than the virtual reference line connecting the lowest part of the support wheel to the lowest part of the auxiliary wheel, and the lowest parts of the first mop and the second mop are lower than the reference line. As a result, mopping may be performed by the first mop and the second mop when the first mop and the second mop are coupled to the first rotating plate and the second rotating plate, and the first rotating plate and the second rotating plate may be spaced apart from the floor when the first mop and the second mop are separated from the first rotating plate and the second rotating plate.

According to embodiments of the present disclosure, the cleaner may prevent the first rotating plate and the second rotating plate from rubbing against the floor even when the operation of the cleaner is performed when the first mop and the second mop are separated from the first rotating plate and the second rotating plate. Moreover, the present disclosure can provide an effect of effectively preventing the cleaner or the floor from being damaged as the support wheel and the auxiliary wheel move while rolling on the floor, even when the cleaner unintendedly moves on the floor.

According to embodiments of the present disclosure, the cleaner includes the first actuator disposed above the first rotating plate, the second actuator disposed above the second rotating plate, the battery disposed to lean toward the first support wheel and the second support wheel, and the water bottle disposed above the auxiliary wheel. Accordingly, upon initial operation of the cleaner, cleaning can be performed while only the first mop and the second mop contact the floor, and as the liquid is exhausted, cleaning can be performed while the first mop and the second mop and the first support wheel and the second support wheel contact the floor.

Thus, stable mopping can be performed even when the cleaner includes a water bottle which is not disposed at the center of gravity, and the height of the cleaner can be formed to be relatively low (flat). Further, in the cleaner according to embodiments of the present disclosure, as the rotation axis of the first support wheel and the rotation axis of the second support wheel are parallel to the virtual connection line connecting the rotation axis of the first rotating plate to the rotation axis of the second rotating plate, the first support wheel and the second support wheel can assist in forward movement of the cleaner.

In certain examples, a cleaner comprises: a body; a first rotating plate and a second rotating plate rotatably coupled to the body; a first mop detachably attached to a bottom surface of the first rotating plate; a second mop detachably attached to a bottom surface of the second rotating plate; a first front wheel and a second front wheel coupled to the body in front of the first rotating plate and the second rotating plate; and a rear wheel coupled to the body rear of the first rotating plate and the second rotating plate, wherein a lowest region of the first rotating plate is positioned above a first reference line between a lowest end of the first front wheel and a lowest end of the rear wheel, and a lowest region of the first mop is positioned below the first reference line, and a lowest region of the second rotating plate is positioned above a second reference line between a lowest end of the second front wheel and the lowest end of the rear wheel, and a lowest region of the second mop is positioned below the second reference line.

The first rotating plate, the second rotating plate, the first front wheel, the second front wheel, and the rear wheel are respectively coupled to a lower region of the body, the first front wheel is positioned closer to the first rotating plate than the second rotating plate, and wherein the second front wheel is positioned closer to the second rotating plate than the first rotating plate. The first rotating plate and the second rotating plate are positioned symmetrical to each other with respect to a midline of the body that extends in a front-to-rear direction, and the first front wheel and the second front wheel are symmetrical to each other with respect to the midline of the body that extends in the front-to-rear direction.

A width of each of the first front wheel, the second front wheel, and the rear wheel is less than a tenth of a diameter of the first rotating plate or a diameter of the second rotating plate. The diameter of each of the first rotating plate and the second rotating plate is greater than a third of a diameter of the body and less than a half of the diameter of the body, and a diameter of each of the first mop and the second mop is greater than a third of the diameter of the body and less than two thirds of the diameter of the body.

When a first horizontal distance between a center of the first front wheel and a center of the second front wheel is in a range of 0.8 to 1.2 times a second distance between a center of rotation of the first rotating plate and a center of rotation of the second rotating plate. A rotation axis of the first front wheel and a rotation axis of the second front wheel extend parallel to a line between rotational centers of the first rotating plate and a second rotating plate. The rear wheel is coupled to the body via a rear wheel body that is rotatably coupled to a lower surface of the body, and a rotation axis of the rear wheel and a rotation axis of the rear wheel body intersect each other.

A center of gravity of the cleaner is located inside a rectangular area formed using a center of the first rotating plate, a center of the second rotating plate, a center of the first front wheel, and a center of the second front wheel as respective vertices. The cleaner is supported at four points by the first mop, the second mop, the first front wheel, and the second front wheel.

The first rotating plate and the second rotating plate are inclined with respect to a bottom surface of the body such that interior sides of the first rotating plate and the second rotating plate that are closer to each other are spaced further apart from the floor surface than exterior sides of the first rotating plate and the second rotating plate that are relatively farther from each other. The cleaner further comprises: a container to store liquid, the container being coupled to the body; and a supply tube connected to the container so as to supply liquid in the container to the first mop and the second mop, wherein the container is positioned above the rear wheel.

The cleaner may further comprise: a first actuator provided in the body to rotate the first rotating plate, the first actuator having a center of gravity located inside a vertical area associated with the first rotating plate; a second actuator provided in the body to rotate the second rotating plate, the second actuator having a center of gravity located inside a vertical area associated with the second rotating plate; and a battery coupled to the body to supply a power to at least one of the first actuator and the second actuator, the battery being positioned in a rectangular vertical area formed using a center of the first rotating plate, a center of the second rotating plate, a center of the first front wheel, and a center of the second front wheel as respective vertices.

The cleaner may further comprise: a first actuator coupled to the body to rotate the first rotating plate; a second actuator coupled to the body to rotate the second rotating plate; and a controller configured to control operation of the first actuator and the second actuator. The cleaner may further comprise: a bumper coupled along the edge of the body so as to move relative to the body; and a first sensor coupled to the body, the first sensor being configured to sense when the bumper moves relative to the body, wherein the controller is configured to control the operation of at least one of the first actuator or the second actuator based on whether the first sensor senses the bumper moving relative to the body.

The cleaner may further comprise: a second sensor coupled to the body, the second sensor being configured to sense a relative distance from an obstacle, wherein the controller is configured to control the operation of the first actuator and the second actuator based on the relative distance from the obstacle detected the second sensor.

In certain examples, a cleaner comprises: a body; a first rotating plate and a second rotating plate rotatably coupled to a lower surface of the body; a first mop detachably attached to a bottom surface of the first rotating plate; a second mop detachably attached to a bottom surface of the second rotating plate; a front wheel coupled to the lower surface of the body in front of the first plate and the second rotating plate; and a rear wheel coupled to the lower region of the body at a rear of the first rotating plate and the second rotating plate, wherein a lowest end of the first rotating plate and a lowest end of the second rotating plate are positioned higher than a reference line extending between a lowest end of the front wheel and a lowest end of the rear wheel, and the first mop and the second mop extend below the reference line.

A rotation axis of the front wheel is parallel to line between a center of the first rotating plate and a center of the second rotating plate. The rear wheel is coupled to the body via a rear wheel body that is rotatably coupled to the lower surface of the body, and a rotation axis of the rear wheel and a rotation axis of the rear wheel body intersect each other.

The cleaner may further comprise: a container to store liquid, the container being coupled to the body; and a supply tube connected to the container so as to supply liquid in the container to the first mop and the second mop, wherein the container is positioned above the rear wheel.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a body;

a first rotating plate and a second rotating plate rotatably coupled to the body;

a first mop configured to be detachably attached to a bottom surface of the first rotating plate;

a second mop configured to be detachably attached to a bottom surface of the second rotating plate;

a first front wheel and a second front wheel coupled to the body in front of the first rotating plate and the second rotating plate; and a rear wheel coupled to the body rear of the first rotating plate and the second rotating plate, wherein:

the first rotating plate is positioned above a first reference line between a bottom of the first front wheel and a bottom of the rear wheel, and at least a portion of the first mop is positioned below the first reference line, the second rotating plate is positioned above a second reference line between a bottom of the second front wheel and the bottom of the rear wheel, and at least a portion of the second mop is positioned below the second reference line, and the first rotating plate and the second rotating plate are inclined with respect to a bottom surface of the body such that interior sides of the first rotating plate and the second rotating plate that are closer to each other are spaced further from the floor surface than exterior sides of the first rotating plate and the second rotating plate that are relatively farther from each other.

2. The cleaner of claim 1, wherein the first rotating plate, the second rotating plate, the first front wheel, the second front wheel, and the rear wheel are coupled to a lower region of the body, wherein the first front wheel is positioned closer to the first rotating plate than the second rotating plate, and wherein the second front wheel is positioned closer to the second rotating plate than the first rotating plate.

3. The cleaner of claim 1, wherein the first rotating plate and the second rotating plate are positioned symmetrical to each other with respect to a midline of the body that extends in a front-to-rear direction, and wherein the first front wheel and the second front wheel are symmetrical to each other with respect to the midline of the body that extends in the front-to-rear direction.

4. The cleaner of claim 1, wherein widths of the first front wheel, the second front wheel, and the rear wheel are less than a tenth of a diameter of the first rotating plate or a diameter of the second rotating plate.

5. The cleaner of claim 4, wherein each of the diameters of the first rotating plate and the second rotating plate is in a range of a third to a half of a diameter of the body, and wherein each of a diameter of the first mop and a diameter of the second mop is in a range of a third to two thirds of the diameter of the body.

6. The cleaner of claim 1, wherein when a first horizontal distance between a center of the first front wheel and a center of the second front wheel is in a range of 0.8 to 1.2 times a second distance between a center of rotation of the first rotating plate and a center of rotation of the second rotating plate.

7. The cleaner of claim 1, wherein a rotation axis of the first front wheel and a rotation axis of the second front wheel extend parallel to a line between centers of rotation the first rotating plate and a second rotating plate.

8. The cleaner of claim 7, wherein the rear wheel is coupled to the body via a rear wheel body that is rotatably coupled to a lower surface of the body, and wherein a rotation axis of the rear wheel and a rotation axis of the rear wheel body intersect each other.

9. The cleaner of claim 1, wherein a center of gravity of the cleaner is located inside an area formed using a center of the first rotating plate, a center of the second rotating plate, the first front wheel, and the second front wheel as respective vertices.

10. The cleaner of claim 1, wherein the cleaner is supported at four points by the first mop, the second mop, the first front wheel, and the second front wheel.

11. The cleaner of claim 1, further comprising:

a container to store liquid, the container being coupled to the body; and a supply tube connected to the container so as to supply liquid in the container to the first mop and the second mop, wherein the container is positioned above the rear wheel.

12. The cleaner of claim 1, further comprising:

a first actuator provided in the body to rotate the first rotating plate, the first actuator having a center of gravity located inside a vertical area associated with the first rotating plate;

a second actuator provided in the body to rotate the second rotating plate, the second actuator having a center of gravity located inside a vertical area associated with the second rotating plate; and a battery coupled to the body to supply power to at least one of the first actuator or the second actuator, the battery being positioned in an area formed using a center of the first rotating plate, a center of the second rotating plate, a center of the first front wheel, and a center of the second front wheel as respective vertices.

13. The cleaner of claim 1, further comprising:

a first actuator coupled to the body to rotate the first rotating plate;

a second actuator coupled to the body to rotate the second rotating plate; and a controller configured to control operation of the first actuator and the second actuator.

14. The cleaner of claim 13, further comprising:

a bumper coupled along the edge of the body so as to move relative to the body; and a first sensor coupled to the body, the first sensor being configured to sense when the bumper moves relative to the body, wherein the controller is configured to control the operation of at least one of the first actuator or the second actuator based on whether the first sensor senses the bumper moving relative to the body.

15. The cleaner of claim 14, further comprising:

a second sensor coupled to the body, the second sensor being configured to sense a distance from an obstacle, wherein the controller is configured to control the operation of the first actuator and the second actuator based on the distance from the obstacle detected the second sensor.

16. A cleaner comprising:

a body;

a first rotating plate and a second rotating plate rotatably coupled to a lower surface of the body;

a first mop configured to be detachably attached to a bottom surface of the first rotating plate;

a second mop configured to be detachably attached to a bottom surface of the second rotating plate;

a front wheel coupled to the lower surface of the body in front of the first plate and the second rotating plate; and a rear wheel coupled to the lower region of the body at a rear of the first rotating plate and the second rotating plate, wherein the first rotating plate and the second rotating plate are positioned higher than a reference line extending between a bottom of the front wheel and a bottom of the rear wheel, and the first mop and the second mop extend below the reference line, wherein the first rotating plate and the second rotating plate are inclined with respect to a bottom surface of the body such that interior sides of the first rotating plate and the second rotating plate that are closer to each other are spaced further from the floor surface than exterior sides of the first rotating plate and the second rotating plate that are relatively farther from each other.

17. The cleaner of claim 16, wherein a rotation axis of the front wheel is parallel to a line between a center of the first rotating plate and a center of the second rotating plate.

18. The cleaner of claim 16, wherein the rear wheel is coupled to the body via a rear wheel body that is rotatably coupled to the lower surface of the body, and wherein a rotation axis of the rear wheel and a rotation axis of the rear wheel body intersect each other.

19. The cleaner of claim 16, further comprising:

a container to store liquid, the container being configured to be coupled to the body; and a supply tube connected to the container so as to supply liquid in the container to at least one of the first mop or the second mop, wherein the container is positioned above the rear wheel.

20. A cleaner comprising:

a body;

a first rotating plate and a second rotating plate rotatably coupled to the body;

a first mop configured to be detachably attached to a bottom surface of the first rotating plate;

a second mop configured to be detachably attached to a bottom surface of the second rotating plate;

a first front wheel and a second front wheel coupled to the body in front of the first rotating plate and the second rotating plate;

a rear wheel coupled to the body rear of the first rotating plate and the second rotating plate;

a first actuator provided in the body to rotate the first rotating plate, the first actuator having a center of gravity located inside a vertical area associated with the first rotating plate;

a second actuator provided in the body to rotate the second rotating plate, the second actuator having a center of gravity located inside a vertical area associated with the second rotating plate; and a battery coupled to the body to supply power to at least one of the first actuator or the second actuator, the battery being positioned in an area formed using a center of the first rotating plate, a center of the second rotating plate, a center of the first front wheel, and a center of the second front wheel as respective vertices, wherein the first rotating plate is positioned above a first reference line between a bottom of the first front wheel and a bottom of the rear wheel, and at least a portion of the first mop is positioned below the first reference line, and the second rotating plate is positioned above a second reference line between a bottom of the second front wheel and the bottom of the rear wheel, and at least a portion of the second mop is positioned below the second reference line.

* * * * *